US009965950B2

(12) United States Patent
Xu et al.

(10) Patent No.: US 9,965,950 B2
(45) Date of Patent: May 8, 2018

(54) METHOD AND APPARATUS FOR CLASSIFYING A TRAFFIC JAM FROM PROBE DATA

(71) Applicant: HERE Global B.V., Eindhoven (NL)

(72) Inventors: Bo Xu, Lisle, IL (US); Tiffany Barkley, Oakland, CA (US); Andrew Lewis, Berkeley, CA (US); Jane MacFarlane, Oakland, CA (US); Davide Pietrobon, Berkeley, CA (US); Matei Stroila, Chicago, IL (US)

(73) Assignee: HERE Global B.V., Eindhoven (NL)

( * ) Notice: Subject to any disclaimer, the term of this patent is extended or adjusted under 35 U.S.C. 154(b) by 45 days.

(21) Appl. No.: 15/172,897

(22) Filed: Jun. 3, 2016

(65) Prior Publication Data

US 2017/0352262 A1 Dec. 7, 2017

(51) Int. Cl.
*G08G 1/01* (2006.01)

(52) U.S. Cl.
CPC ..... *G08G 1/0133* (2013.01); *G08G 1/0112* (2013.01)

(58) Field of Classification Search
CPC ..... G08G 1/0133; G08G 1/0112
See application file for complete search history.

(56) References Cited

U.S. PATENT DOCUMENTS 9,041,553 B2 * 5/2015 Sako ..... G01C 21/34 340/901
9,240,123 B2 * 1/2016 Stenneth ..... G08G 1/0125
2001/0026276 A1 * 10/2001 Sakamoto ..... G01C 21/3638 345/473
2007/0208496 A1 * 9/2007 Downs ..... G08G 1/0112 701/117
2012/0173530 A1 * 7/2012 Kurciska ..... G06F 17/30241 707/738

(Continued)

FOREIGN PATENT DOCUMENTS

JP 2005285108 A 10/2005

OTHER PUBLICATIONS

Parkany et al., "A Complete Review of Incident Detection Algorithms & Their Deployment: What Works and What Doesn't", Technical Report prepared for the New England Transportation Consortium, Project No. 00-7, Feb. 7, 2005, 120 Pages.

(Continued)

*Primary Examiner* — Courtney D Heinle
(74) *Attorney, Agent, or Firm* — Ditthavong & Steiner, P.C.

(57) ABSTRACT

An approach is provided for classifying a traffic jam from probe data. The approach involves receiving the probe data that is map-matched to a roadway on which the traffic jam is detected. The probe data is collected from one or more vehicles traveling the roadway. The approach also involves determining a jam area of the roadway based on the probe data. The jam area corresponds to one or more segments of the roadway affected by the traffic jam. The approach further involves determining a set of features indicated by the probe data from a portion of the probe data collected from the jam area. The approach further involves classifying, using a machine learning classifier, the traffic jam as either a recurring traffic jam or a non-recurring traffic jam based on the set of features.

20 Claims, 13 Drawing Sheets

(56) References Cited

U.S. PATENT DOCUMENTS

| | | | | |
|---|---|---|---|---|
| 2013/0282264 | A1* | 10/2013 | Bastiaensen | G01C 21/3492 701/119 |
| 2013/0304333 | A1* | 11/2013 | Fuehrer | G08G 1/0112 701/51 |
| 2014/0222321 | A1* | 8/2014 | Petty | G01C 21/3492 701/117 |
| 2015/0081196 | A1* | 3/2015 | Petty | G08G 1/0133 701/118 |
| 2015/0170512 | A1* | 6/2015 | Scofield | G01C 21/3492 701/118 |
| 2015/0262480 | A1* | 9/2015 | Fowe | G01C 21/3492 701/117 |
| 2016/0078758 | A1* | 3/2016 | Basalamah | G08G 1/0112 701/118 |
| 2016/0210852 | A1* | 7/2016 | Buchholz | G08G 1/0112 |
| 2016/0210853 | A1* | 7/2016 | Koravadi | G08G 1/0141 |
| 2016/0247397 | A1* | 8/2016 | Xu | G08G 1/0125 |

OTHER PUBLICATIONS

Motamed et al., "Real Time Freeway Incident Detection", Texas : Southwest Region University Transportation Center, Apr. 2014, 42 Pages.

Xie et al., "Use of driver-based data for incident detection", 7th International Conference on Application of Advanced Technologies in Transportation Engineering, Aug. 5-7, 2002, 8 Pages.

Liu et al., "Traffic Incident Detection Algorithm for Urban Expressways Based on Probe Vehicle Data", Journal of Transportation systems engineering and information technology, vol. 8, No. 4, Aug. 2008, pp. 36-41. (Abstract).

Petty et al., "Incident detection with probe vehicles: performance, infrastructure requirements and feasibility", Transportation Systems 1997: A Proceedings Volume from the 8th IFAC/IFIP/IFORS Symposium, Jun. 16-18, 1997, vol. 1, pp. 125-130.

Balke et al., "Using probe-measured travel times to detect major freeway incidents in Houston, Texas", Transportation Research Record, Journal of the Transportation Research Board, Sep. 1996, vol. 1554, No. 1, pp. 213-220.

Teng et al., "Developed incident detection algorithm compared with neural network algorithms", Article in Transportation Research Record, Journal of the Transportation Research Board, Jan. 2003, vol. 1836, No. 1, pp. 83-92.

Jiang et al., "Traffic States Detection based on Block Matching", International Conference on Chemical, Material and Food Engineering (CMFE—2015), Aug. 2015, pp. 890-893.

* cited by examiner

METHOD AND APPARATUS FOR CLASSIFYING A TRAFFIC JAM FROM PROBE DATA

RELATED APPLICATION

U.S. patent application Ser. No. 14/629,628, titled "Method and Apparatus for Providing Traffic Jam Detection and Prediction," filed Feb. 24, 2015, (hereinafter "U.S. Ser. No. 14/269,628") is incorporated by reference herein in its entirety. The method and apparatus for detecting a traffic jam as described in U.S. Ser. No. 14/629,628 comprise one example process for detecting a traffic jam on a roadway that can be used with the various embodiments described herein.

BACKGROUND

Modern navigation systems are generally able to inform their users of upcoming traffic situations to try to avoid travel delay or to get more information about the situations. For example, drivers can often encounter traffic jams on roadways that result in varying degrees of travel delays. Generally, traffic jams can be divided into two categories: recurring traffic jams and non-recurring traffic jams. Recurring traffic jams are, e.g., jams that occur regularly such as during rush hour or at known bottleneck intersections. Non-recurring traffic jams are caused by unexpected incidents such as accidents, breakdowns, etc. Providing information on the specific type of traffic can potentially reduce congestion and improve driver safety. Accordingly, navigation service providers face significant technical challenges classifying the type of traffic jam once the traffic jam is detected to provide users timely information on traffic jams, particularly when trying to classify traffic jams based just on probe data collected (e.g., including vehicle telemetry data) from vehicles traveling the affected roadway.

SOME EXAMPLE EMBODIMENTS

Therefore, there is a need for an approach for classifying a traffic jam from probe data.

According to one embodiment, a computer-implemented method for classifying a traffic jam using probe data comprises receiving the probe data that is map-matched to a roadway on which the traffic jam is detected. The probe data, for instance, is collected from one or more vehicles traveling the roadway. The method also comprises determining a jam area of the roadway based on the probe data. The jam area corresponds to one or more segments of the roadway affected by the traffic jam. The method further comprises a set of features indicated by the probe data from a portion of the probe data collected from the jam area. The method further comprises classifying, using a machine learning classifier, the traffic jam as either a recurring traffic jam or a non-recurring traffic jam based on the set of features.

In another embodiment, the method also comprises determining a downstream area of the roadway. The downstream area corresponds to one or more other segments of the roadway downstream from the jam area. The method further comprises determining another set of features indicated by the probe data from another portion of the probe data collected from the downstream area. The classifying of the traffic jam is further based on the another set of features.

According to another embodiment, an apparatus comprises at least one processor, and at least one memory including computer program code for one or more computer programs, the at least one memory and the computer program code configured to, with the at least one processor, cause, at least in part, the apparatus to receive probe data that is map-matched to a roadway on which a traffic jam is detected. The probe data, for instance, is collected from one or more vehicles traveling the roadway. The apparatus is also caused to determine a jam area of the roadway based on the probe data. The jam area corresponds to one or more segments of the roadway affected by the traffic jam. The apparatus is further caused to determine a set of features indicated by the probe data from a portion of the probe data collected from the jam area. The apparatus is further caused to classify, using a machine learning classifier, the traffic jam as either a recurring traffic jam or a non-recurring traffic jam based on the set of features.

In another embodiment, the apparatus is further caused to determine a downstream area of the roadway. The downstream area corresponds to one or more other segments of the roadway downstream from the jam area. The apparatus is further caused to determine another set of features indicated by the probe data from another portion of the probe data collected from the downstream area. The classifying of the traffic jam is further based on the another set of features.

According to another embodiment, a computer-readable storage medium carries one or more sequences of one or more instructions which, when executed by one or more processors, cause, at least in part, an apparatus to receive probe data that is map-matched to a roadway on which a traffic jam is detected. The probe data, for instance, is collected from one or more vehicles traveling the roadway. The apparatus is also caused to determine a jam area of the roadway based on the probe data. The jam area corresponds to one or more segments of the roadway affected by the traffic jam. The apparatus is further caused to determine a set of features indicated by the probe data from a portion of the probe data collected from the jam area. The apparatus is further caused to classify, using a machine learning classifier, the traffic jam as either a recurring traffic jam or a non-recurring traffic jam based on the set of features.

In another embodiment, the apparatus is further caused to determine a downstream area of the roadway. The downstream area corresponds to one or more other segments of the roadway downstream from the jam area. The apparatus is further caused to determine another set of features indicated by the probe data from another portion of the probe data collected from the downstream area. The classifying of the traffic jam is further based on the another set of features.

According to another embodiment, an apparatus comprises means for receiving the probe data that is map-matched to a roadway on which the traffic jam is detected. The probe data, for instance, is collected from one or more vehicles traveling the roadway. The apparatus also comprises means for determining a jam area of the roadway based on the probe data. The jam area corresponds to one or more segments of the roadway affected by the traffic jam. The apparatus further comprises means for determining a set of features indicated by the probe data from a portion of the probe data collected from the jam area. The apparatus further comprises means for classifying, using a machine learning classifier, the traffic jam as either a recurring traffic jam or a non-recurring traffic jam based on the set of features.

In another embodiment, the apparatus further comprises means for determining a downstream area of the roadway. The downstream area corresponds to one or more other segments of the roadway downstream from the jam area. The apparatus further comprises means for determining another set of features indicated by the probe data from another portion of the probe data collected from the downstream area. The classifying of the traffic jam is further based on the another set of features.

In addition, for various example embodiments of the invention, the following is applicable: a method comprising facilitating a processing of and/or processing (1) data and/or (2) information and/or (3) at least one signal, the (1) data and/or (2) information and/or (3) at least one signal based, at least in part, on (or derived at least in part from) any one or any combination of methods (or processes) disclosed in this application as relevant to any embodiment of the invention.

For various example embodiments of the invention, the following is also applicable: a method comprising facilitating access to at least one interface configured to allow access to at least one service, the at least one service configured to perform any one or any combination of network or service provider methods (or processes) disclosed in this application.

For various example embodiments of the invention, the following is also applicable: a method comprising facilitating creating and/or facilitating modifying (1) at least one device user interface element and/or (2) at least one device user interface functionality, the (1) at least one device user interface element and/or (2) at least one device user interface functionality based, at least in part, on data and/or information resulting from one or any combination of methods or processes disclosed in this application as relevant to any embodiment of the invention, and/or at least one signal resulting from one or any combination of methods (or processes) disclosed in this application as relevant to any embodiment of the invention.

For various example embodiments of the invention, the following is also applicable: a method comprising creating and/or modifying (1) at least one device user interface element and/or (2) at least one device user interface functionality, the (1) at least one device user interface element and/or (2) at least one device user interface functionality based at least in part on data and/or information resulting from one or any combination of methods (or processes) disclosed in this application as relevant to any embodiment of the invention, and/or at least one signal resulting from one or any combination of methods (or processes) disclosed in this application as relevant to any embodiment of the invention.

In various example embodiments, the methods (or processes) can be accomplished on the service provider side or on the mobile device side or in any shared way between service provider and mobile device with actions being performed on both sides.

For various example embodiments, the following is applicable: An apparatus comprising means for performing the method of any of the claims.

Still other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

The embodiments of the invention are illustrated by way of example, and not by way of limitation, in the figures of the accompanying drawings.

DESCRIPTION OF SOME EMBODIMENTS

Examples of a method, apparatus, and computer program for classifying a traffic jam from probe data are disclosed. In the following description, for the purposes of explanation, numerous specific details are set forth in order to provide a thorough understanding of the embodiments of the invention. It is apparent, however, to one skilled in the art that the embodiments of the invention may be practiced without these specific details or with an equivalent arrangement. In other instances, well-known structures and devices are shown in block diagram form in order to avoid unnecessarily obscuring the embodiments of the invention. Although various embodiments are described with respect to predicting traffic jams in travel segments, it is contemplated that the approach described herein may be used to predict traffic jams in other situations (e.g., waterways, railways, airways, etc.).

Figure 1A:
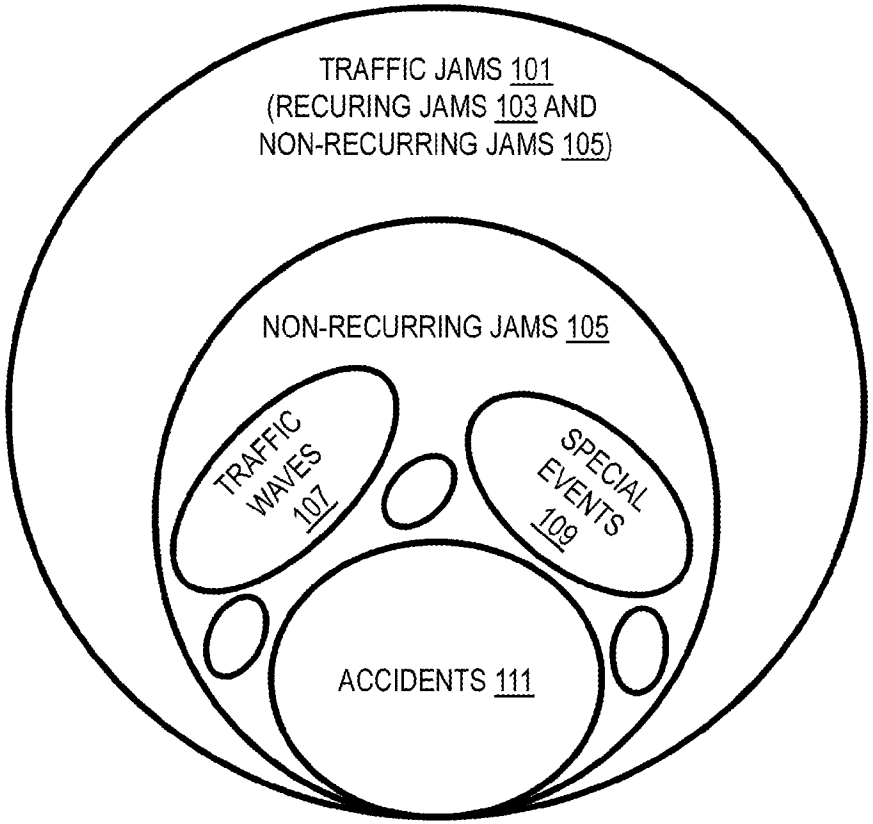
FIG. 1A is a diagram illustrating recurring and non-recurring traffic jams, according to one embodiment.

As shown in FIG. 1A, traffic jams 101 on a roadway can be divided into two categories, namely recurring jams 103 and non-recurring jams 105. In one embodiment, recurring jams 103 are jams 101 that occur regularly or predictably such as during rush hours, at bottleneck intersections, at traffic lights, and the like. In one embodiment, non-recurring jams 105 are jams 101 caused by unexpected or non-regular incidents such as traffic waves 107, special events 109, and accidents 111. Other examples of incidents include, but are not limited to, breakdowns, debris, spilled loads, inclement weather, unscheduled maintenance, construction activities, and the like. Historically, the U.S. Department of Transportation has estimated that more than half of traffic jams 101 are non-recurring jams 105. Accordingly, prompt and reliable incident detection can potentially reduce incident-induced congestion and the number of secondary incidents (e.g., accidents 111) that can arise from an initial incident. For example, drivers' navigation systems can reroute or adjust estimated arrive time (ETA) in response to incident occurrences if such incidents can be classified or determined from a detected jam 101.

Figure 1B:
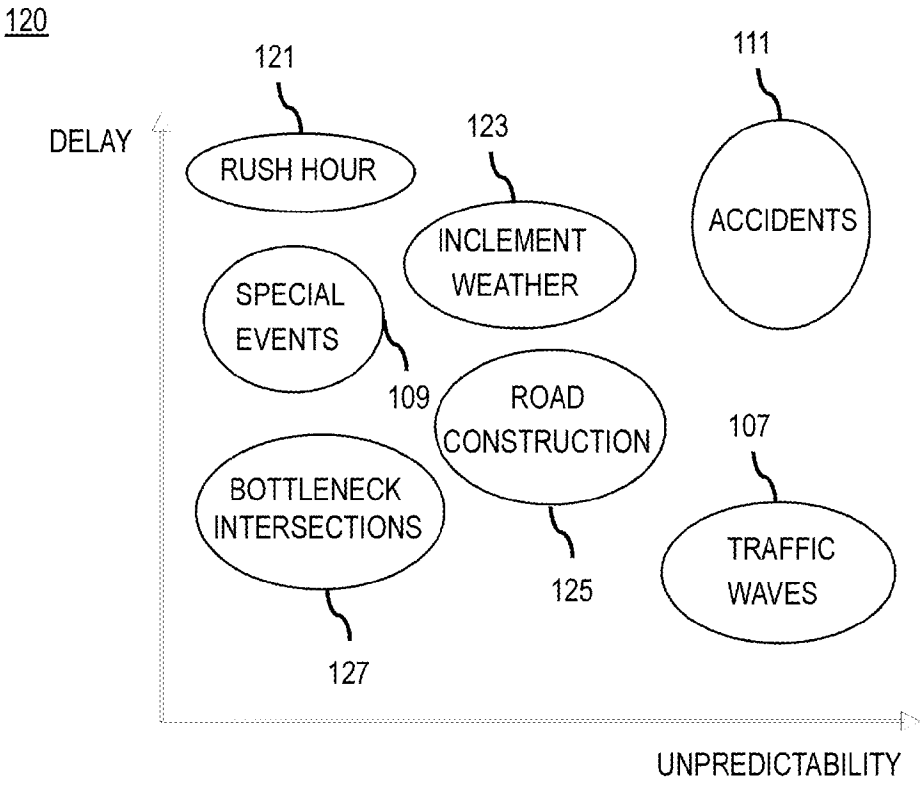
FIG. 1B is a graph indicating relative positions of types of traffic jams in terms of predictability and induced delay, according to one embodiment.

FIG. 1B illustrates a graph 120 of the typical positions of various types of traffic jam causes in terms of their predictability and induced travel delay. The graph 120 illustrates different types of causes of recurring traffic jams 103 (e.g., rush hour 121 and bottleneck intersections 127), and types of causes of non-recurring traffic jams 105 (e.g., special events 109, inclement weather 123, road construction 125, traffic waves 107, and accidents 111). For example, rush hour traffic jams 121 usually cause lasting and heavy congestion but they are highly predictable. Traffic waves 107, on the other hand, are highly unpredictable but they usually only cause intermittent and minor congestion. By way of example, traffic waves 107 (e.g., also known as "stop waves" or "traffic shocks") are traveling disturbances in the distribution of cars on a roadway. The disturbances, for instance, result in waves of cars clumping together as the slow or speed up on a roadway (e.g., caused by the sudden braking of one car that propagates the braking to cars following behind). In the graph 120, accidents 111 occupy a graph position that indicates that they are highly unpredictable and they often cause long lasting and heavy congestion. Similarly, special events 109 (e.g., concerts or sporting events) are predictable and can cause moderate congestion; inclement weather 123 can be moderately unpredictable and can cause moderate to heavy congestion; and road construction 125 can be moderately unpredictable and cause moderate congestion.

Accordingly, from the above discussion, it is clear that there is technical problem in the art associated with automatically detecting and classifying traffic jams 101 and, particularly detecting accidents 111, in real-time or at least continuously in a batch to approximate real-time classification. Historically, traffic surveillance can be performed manually or automatically in an attempt to detect accidents on roadways. By way of example, there generally are three types of manual surveillance methods: (1) closed-circuit television (CCTV) monitoring, (2) highway patrol/maintenance crew patrol, and (3) driver/witness report and police report. However, there are drawbacks to each approach. For example, CCTV systems often require extensive infrastructure support. Highway crew patrols are labor intensive in nature which can limit their wide deployment. Driver/witness reporting (e.g., crowd-sourced reports) is becoming increasingly popular in recent years due, in part, to the proliferation of cellphone usage. Nonetheless, like all of the manual surveillance methods, driver/witness reporting requires human involvement and therefore are not always reliable due to delay and errors of human processing.

With respect to automatic traffic surveillance, most of the existing automatic surveillance systems use roadway-based sensors such as inductive loop detectors, magnetic sensors, microwave radars, infrared sensors, Bluetooth devices, etc. These sensors, for instance, monitor traffic conditions at fixed location, so that they generally do not represent comprehensive roadway conditions. Furthermore, they can be expensive to deploy and maintain. Recently, probe based systems are receiving more and more development interest. Compared to roadway-based sensors, for instance, probe vehicles are mobile and hence can sense the spatial variation of traffic flow over a wide area. With the increase in the penetration rate of probe vehicles, the collected traffic information from probe data can better reflect actual traffic conditions. In one embodiment, the probe data can include telemetry data of the vehicle such as probe identifier, speed, longitude, latitude, time, and/or other data available from the vehicle (e.g., data available from the vehicle's on-board diagnostics system).

Figure 2A:
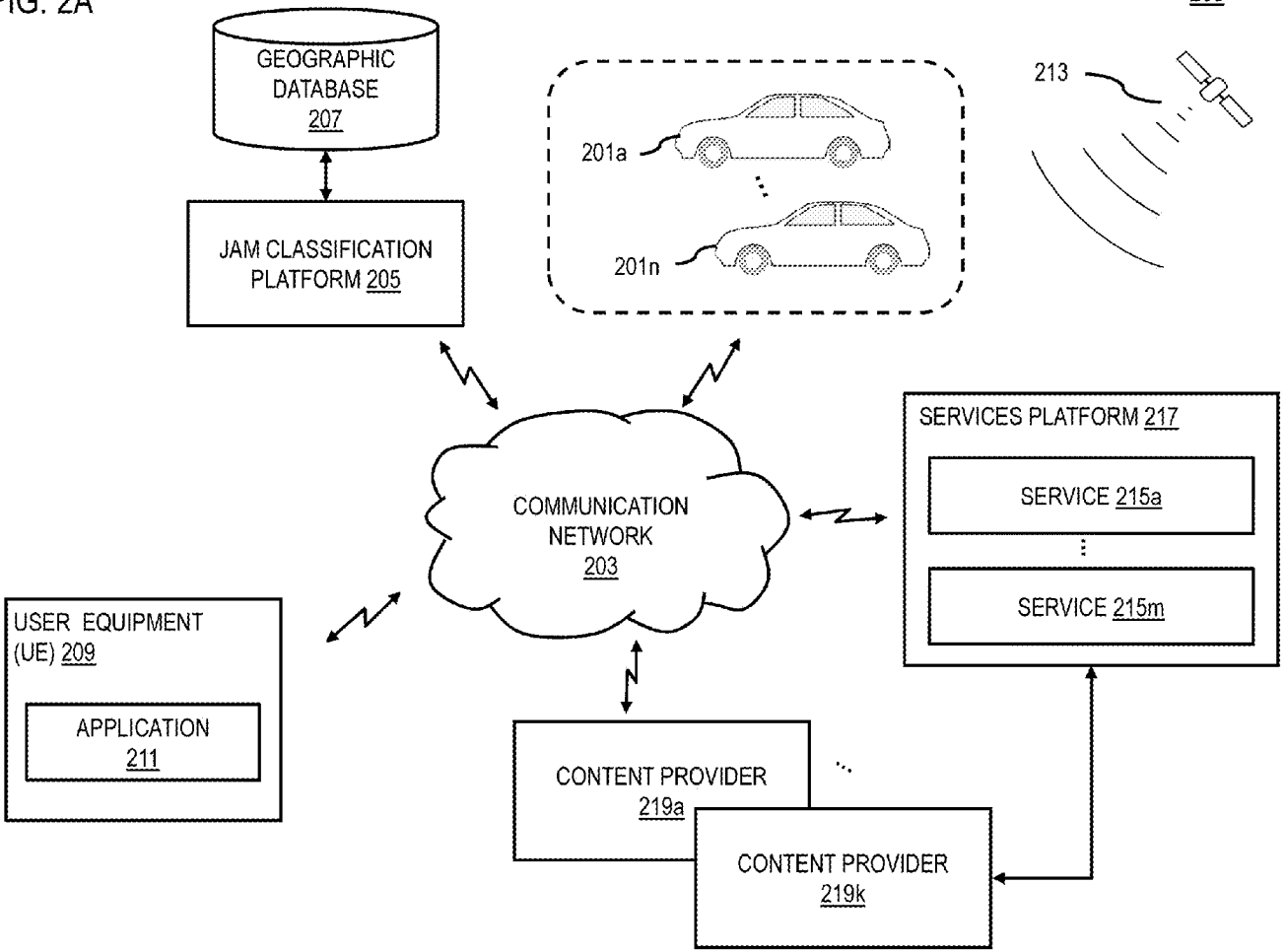
FIG. 2A is a diagram of a system capable of classifying a traffic jam from probe data, according to one embodiment.

To address the problem of detecting and classifying traffic jams, a system 200 as shown in FIG. 2A introduces a capability to detect traffic jams caused by non-recurring incidents (e.g., accidents 111) and distinguish them from recurring jams 103 (e.g., caused by rush hour congestion or bottleneck intersections). In one embodiment, the system 100 distinguishes or classifies the traffic jams 101 among the different types of jams by determining an area affected by a traffic jam 101 in the roadway (e.g., a jam area). In one embodiment, the system 100 can also determine an area of the roadway downstream from the jam area (e.g., a downstream area). For example, the downstream area refers to an area of the roadway immediately following the jam area affected by a detected traffic jam 101. In one embodiment, the downstream area can be detected as the area where the speed of the probe points returns to normal or average speed for a road segment after encountering a traffic jam 101. Features of the probe data collected from the jam area and/or the downstream area can then be extracted to train a machine learning classifier against ground truths (e.g., known or observed types of traffic jams 101). In embodiments where no probe data is available from the downstream area or consideration of the downstream area is not desired, the system 100 can classify the traffic using only the features extracted from the probe data collected in the jam area. In one embodiment, the system 100 then uses the machine learning classifier to classify types of traffic jams 101 from subsequently collected probe data. In this way, the system 100 advantageously increases response time and reliability for classifying non-recurring traffic jams 105 from probe data.

In one embodiment, the system 200 can further distinguish between different types of non-recurring traffic jams 105 such as those caused by accidents 111 from those resulting from other non-recurring causes (e.g., traffic waves 107, special events 109, etc.) using a machine learning classifier trained using probe data from the jam area and the downstream area. In yet another embodiment, the system 100 can determine or classify a severity of the detected non-recurring jams 105 using a similarly trained machine learning classifier.

In one embodiment, the system 200 identifies or classifies non-recurring jams 105 from other traffic jams 101 in real-time or on a continuous batch basis. For example, the system 200 can collect a batch of probe data over a predetermined period of time (e.g., 15 min window) for a roadway. If a traffic jam 101 is detected to occur in the roadway based on the batch of probe data (e.g., using the jam detection process described in U.S. Ser. No. 14/629,628 which is incorporated by reference herein in its entirety), that batch of probe data can be designated as a jam slice. On detection of the jam slice, the development of the congestion arising from the detected jam can be tracked. If jam slices are detected, for instance, around the same distance location for several consecutive time windows (e.g., jam slices), then this set of jam slices is collected as a candidate group and submitted to the machine learning classifier (e.g., trained as described above). The accident classifier can then determine whether this candidate group of jam slices is caused by a non-recurring incident (e.g., an accident). In one embodiment, the classification is based on the features of traffic conditions (e.g., as indicated by the probe data) induced by the non-recurring incident. For example, the features can include the traffic speed/density in the jam area (e.g., as determined from the probe data collected from the jam area) and the traffic speed/density in the downstream area (e.g., as determined from the probe data collected from the downstream area).

In one embodiment, the system 100 can process probe data from multi-lane roadways. In this embodiment, the system 100 can map-match the probe data to each individual lane of the multi-lane roadway. The probe data corresponding to each lane can then be processed and classified as a separate roadway or highway. For example, the jam detection and classification processes described herein can then be applied to each set of probe data corresponding to the individual lanes. The resulting jam detection and/or classification associated with highest confidence can then be designated as the lane in which the jam is location.

As shown in FIG. 2A, the system 200 comprises one or more vehicles 201*a*-201*n* (also collectively referred to as vehicles 201) that as probes traveling over a road network. In one embodiment, each vehicle 201 is assigned a unique probe identifier (probe ID) for use in reporting or transmitting probe data collected by the vehicle 201. The vehicles 201, for instance, are part of a probe-based system for collecting probe data for measuring traffic conditions in a road network. In one embodiment, each vehicle 201 is configured to report probe data as probe points, which are individual data records collected at a point in time that records telemetry data for the vehicle 201 for that point in time. The probe points can reported from the vehicles 201 in real-time, in batches, continuously, or at any other frequency requested by the system 200. In one embodiment, a probe point can include five attributes: (1) probe ID, (2) longitude, (3) latitude, (4) speed, and (5) time. The list of attributes is provided by way of illustration and not limitation. Accordingly, it is contemplated that any combination of these attributes or other attributes may be recorded as a probe point. For example, attributes such as altitude, tilt, steering angle, wiper activation, etc. can be included and reported for a probe point. In one embodiment, the vehicles 201 may include sensors for reporting measuring and/or reporting attributes. The attributes can also be any attribute normally collected by an on-board diagnostic (OBD) system of the vehicle, and available through an interface to the OBD system (e.g., OBD II interface or other similar interface).

In one embodiment, probe-based systems can be categorized into two paradigms: (1) trajectory based and probe-point based. Trajectory-based system, for instance, track the movement of individual vehicles 201 (e.g., as identified by their respective probe IDs) and detect incidents based on the individual vehicles 201's travel characteristics (e.g., speed and heading). In one embodiment, the performance of a trajectory-based system can be controlled by varying the sampling frequency of travel trajectories form the individual vehicles 201. For example, more frequent sampling of the trajectories can provide more detailed information about a trajectory at the expense of resources associated with collecting, processing, and storing more trajectory data. On the other hand, in one embodiment, probe-point based systems detect incidents based on traffic characteristics aggregated from probe points that may belong to different vehicles 201. In one embodiment, the system 200 employs a probe-point based system that treats a roadway as a continuous linear curve and monitors traffic conditions across all links on the roadway, so that the system 200 can report where on the roadway the incident starts to form (e.g., a jam area) and where the traffic starts to release to normal speeds (e.g., a downstream area).

In one embodiment, the probe data collected from the vehicles 201 are transmitted over a communication network 203 to a jam classification platform 205 for detecting and classifying any traffic jams 101 indicated in the probe data as discussed with respect to the various embodiments described herein. In one embodiment, the jam classification platform 205 can be a standalone server or a component of another device with connectivity to the communication network 203. For example, the component can be part of an edge computing network where remote computing devices are installed along or within proximity of a road network to classify traffic jams 101 from probe data collected locally or within a local area served by the remote or edge computing device.

As shown, the jam classification platform 205 has connectivity or access to a geographic database 207 that includes mapping data about a road network (additional description of the geographic database 207 is provided below with respect to FIG. 2B). In one embodiment, the probe data can also be stored in the geographic database 207 by the jam classification platform 205. In addition or alternatively, the probe data can be stored by another component of the system 200 in the geographic database 207 for subsequent retrieval and processing by the jam classification platform 205.

In one embodiment, the system 200 also includes one or more user equipment (UE) 209 that may execute an application 211 to present or use the traffic jam classification results generated by the jam classification platform 205. For example, if the application 211 is a navigation application then the jam classification results can be used to determine routing information (e.g., route around detected accidents), provide updated estimated times of arrival (ETAs) based on detected accidents, provide notifications of the causes of traffic jams, and the like.

By way of example, the UE 209 is any type of embedded system, mobile terminal, fixed terminal, or portable terminal including a built-in navigation system, a personal navigation device, mobile handset, station, unit, device, multimedia computer, multimedia tablet, Internet node, communicator, desktop computer, laptop computer, notebook computer, netbook computer, tablet computer, personal communication system (PCS) device, personal digital assistants (PDAs), audio/video player, digital camera/camcorder, positioning device, fitness device, television receiver, radio broadcast receiver, electronic book device, game device, or any combination thereof, including the accessories and peripherals of these devices, or any combination thereof. It is also contemplated that the UE 209 can support any type of interface to the user (such as "wearable" circuitry, etc.). In one embodiment, the UE 209 may be a vehicle 201 (e.g., cars), a component part of the vehicle 201, a mobile device (e.g., phone), and/or a combination of thereof.

By way of example, the application 211 may be any type of application that is executable at the UE 209, such as mapping application, location-based service applications, navigation applications, content provisioning services, camera/imaging application, media player applications, social networking applications, calendar applications, and the like. In one embodiment, the application 211 at the UE 209 may act as a client for the jam classification platform 205 and perform one or more functions of the jam classification platform 205 alone or in combination with the platform 205.

In one embodiment, the vehicles 201 are configured with various sensors for generating probe data. By way of example, the sensors may include a global positioning sensor for gathering location data (e.g., GPS), a network detection sensor for detecting wireless signals or receivers for different short-range communications (e.g., Bluetooth, Wi-Fi, Li-Fi, near field communication (NFC) etc.), temporal information sensors, a camera/imaging sensor for gathering image data (e.g., the camera sensors may automatically capture obstruction for analysis and documentation purposes), an audio recorder for gathering audio data, velocity sensors mounted on steering wheels of the vehicles, switch sensors for determining whether one or more vehicle switches are engaged, and the like.

In another embodiment, the sensors of the vehicles 201 may include light sensors, orientation sensors augmented with height sensors and acceleration sensor (e.g., an accelerometer can measure acceleration and can be used to determine orientation of the vehicle), tilt sensors to detect the degree of incline or decline of the vehicle along a path of travel, moisture sensors, pressure sensors, etc. In a further example embodiment, sensors about the perimeter of the vehicle may detect the relative distance of the vehicle from lane or roadways, the presence of other vehicles, pedestrians, traffic lights, potholes and any other objects, or a combination thereof. In one scenario, the sensors may detect weather data, traffic information, or a combination thereof. In one example embodiment, the vehicles 201 may include GPS receivers to obtain geographic coordinates from satellites 213 for determining current location and time associated with the vehicle 201 for generating probe data. Further, the location can be determined by a triangulation system such as A-GPS, Cell of Origin, or other location extrapolation technologies.

The communication network 203 of system 200 includes one or more networks such as a data network, a wireless network, a telephony network, or any combination thereof. It is contemplated that the data network may be any local area network (LAN), metropolitan area network (MAN), wide area network (WAN), a public data network (e.g., the Internet), short range wireless network, or any other suitable packet-switched network, such as a commercially owned, proprietary packet-switched network, e.g., a proprietary cable or fiber-optic network, and the like, or any combination thereof. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., worldwide interoperability for microwave access (WiMAX), Long Term Evolution (LTE) networks, code division multiple access (CDMA), wideband code division multiple access (WCDMA), wireless fidelity (Wi-Fi), wireless LAN (WLAN), Bluetooth®, Internet Protocol (IP) data casting, satellite, mobile ad-hoc network (MANET), and the like, or any combination thereof.

In one embodiment, the jam classification platform 205 may be a platform with multiple interconnected components. The jam classification platform 205 may include multiple servers, intelligent networking devices, computing devices, components and corresponding software for classifying a traffic jam from probe data. In addition, it is noted that the jam classification platform 205 may be a separate entity of the system 200, a part of the one or more services 215*a*-215*m* (collectively referred to as services 215) of the services platform 217, or included within the UE 209 (e.g., as part of the applications 211).

The services platform 217 may include any type of service 215. By way of example, the services 215 may include mapping services, navigation services, travel planning services, notification services, social networking services, content (e.g., audio, video, images, etc.) provisioning services, application services, storage services, contextual information determination services, location based services, information based services (e.g., weather, news, etc.), etc. In one embodiment, the services platform 217 may interact with the jam classification platform 205, the UE 209, and/or the content provider 117 to provide the services 215.

In one embodiment, the content providers 219*a*-219*k* (collectively referred to as content providers 219) may provide content or data to the UE 209, the jam classification platform 205, and/or the services 215. The content provided may be any type of content, such as textual content, audio content, video content, image content, etc. In one embodiment, the content providers 219 may provide content that may aid in the detecting and classifying of a traffic jam from probe data. In one embodiment, the content providers 219 may also store content associated with the UE 209, the jam classification platform 205, and/or the services 215. In another embodiment, the content providers 219 may manage access to a central repository of data, and offer a consistent, standard interface to data, such as a repository of probe data, speed limit for one or more road links, speed information for at least one vehicle, traffic jam threshold for at least one road link, other traffic information, etc. Any known or still developing methods, techniques or processes for retrieving and/or accessing features for road links from one or more sources may be employed by the jam classification platform 205.

By way of example, the UE 209, the jam classification platform 205, the services platform 217, and the content providers 219 communicate with each other and other components of the system 200 using well known, new or still developing protocols. In this context, a protocol includes a set of rules defining how the network nodes within the communication network 203 interact with each other based on information sent over the communication links. The protocols are effective at different layers of operation within each node, from generating and receiving physical signals of various types, to selecting a link for transferring those signals, to the format of information indicated by those signals, to identifying which software application executing on a computer system sends or receives the information. The conceptually different layers of protocols for exchanging information over a network are described in the Open Systems Interconnection (OSI) Reference Model.

Communications between the network nodes are typically effected by exchanging discrete packets of data. Each packet typically comprises (1) header information associated with a particular protocol, and (2) payload information that follows the header information and contains information that may be processed independently of that particular protocol. In some protocols, the packet includes (3) trailer information following the payload and indicating the end of the payload information. The header includes information such as the source of the packet, its destination, the length of the payload, and other properties used by the protocol. Often, the data in the payload for the particular protocol includes a header and payload for a different protocol associated with a different, higher layer of the OSI Reference Model. The header for a particular protocol typically indicates a type for the next protocol contained in its payload. The higher layer protocol is said to be encapsulated in the lower layer protocol. The headers included in a packet traversing multiple heterogeneous networks, such as the Internet, typically include a physical (layer 1) header, a data-link (layer 2) header, an internetwork (layer 3) header and a transport (layer 4) header, and various application (layer 5, layer 6 and layer 7) headers as defined by the OSI Reference Model.

Figure 2B:
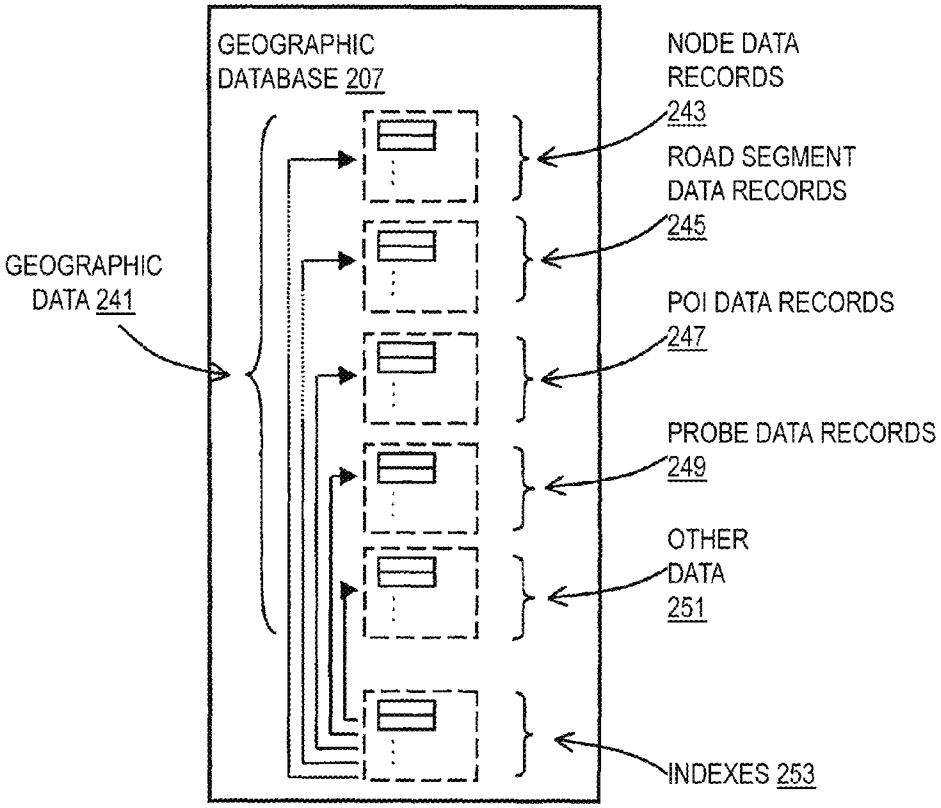
FIG. 2B is a diagram of a geographic database of the system of FIG. 2A, according to one embodiment.

FIG. 2B is a diagram of the geographic database 207 of the system 200, according to one embodiment. In exemplary embodiments, probe data can be stored, associated with, and/or linked to the geographic database 207 or data thereof. In one embodiment, the geographic database 207 includes geographic data 241 used for (or configured to be compiled to be used for) mapping and/or navigation-related services, such as for personalized route determination, according to one embodiment. For example, the geographic database 207 includes node data records 243, road segment or link data records 245, POI data records 247, probe data records 249, other data records 251, and indexes 253. More, fewer or different data records can be provided. In one embodiment, the other data records 251 include cartographic ("carto") data records, routing data, and maneuver data. In one embodiment, the probe data (e.g., collected from probe vehicles 201) can be map-matched to respective map or geographic records via position or GPS data associations (such as using known or future map matching or geo-coding techniques), for example. In one embodiment, the indexes 253 may improve the speed of data retrieval operations in the geographic database 207. The indexes 253 may be used to quickly locate data without having to search every row in the geographic database 207 every time it is accessed.

In various embodiments, the road segment data records 245 are links or segments representing roads, streets, paths, or lanes within multi-lane roads/streets/paths as can be used in the calculated route or recorded route information for determination of one or more personalized routes, according to exemplary embodiments. The node data records 243 are end points corresponding to the respective links or segments of the road segment data records 245. The road link data records 245 and the node data records 243 represent a road network, such as used by vehicles, cars, and/or other entities. Alternatively, the geographic database 207 can contain path segment and node data records or other data that represent pedestrian paths or areas in addition to or instead of the vehicle road record data, for example.

The road/link segments and nodes can be associated with attributes, such as geographic coordinates, street names, address ranges, speed limits, turn restrictions at intersections, lane number, and other navigation related attributes, as well as POIs, such as gasoline stations, hotels, restaurants, museums, stadiums, offices, automobile dealerships, auto repair shops, buildings, stores, parks, etc. The geographic database 207 can include data about the POIs and their respective locations in the POI data records 247. The geographic database 207 can also include data about places, such as cities, towns, or other communities, and other geographic features, such as bodies of water, mountain ranges, etc. Such place or feature data can be part of the POI data records 247 or can be associated with POIs or POI data records 247 (such as a data point used for displaying or representing a position of a city).

In one embodiment, the geographic database 207 can include probe data collected from probe vehicles 201. As previously discussed, the probe data include probe points collected from the probe vehicles 201 and include telemetry data from the vehicles 201 can be used to indicate the traffic conditions at the location in a roadway from which the probe data was collected. In one embodiment, the probe data can be map-matched to the road network or roadways stored in the geographic database 207. In one embodiment, the probe data can be further map-matched to individual lanes (e.g., any of the travel lanes, shoulder lanes, restricted lanes, service lanes, etc.) of the roadways for subsequent processing according to the various embodiments described herein. By way of example, the map-matching can be performed by matching the geographic coordinates (e.g., longitude and latitude) recorded for a probe-point against a roadway or lane within a multi-lane roadway corresponding to the coordinates.

The geographic database 207 can be maintained by the content provider 219 in association with the services platform 217 (e.g., a map developer). The map developer can collect geographic data to generate and enhance the geographic database 207. There can be different ways used by the map developer to collect data. These ways can include obtaining data from other sources, such as municipalities or respective geographic authorities. In addition, the map developer can employ field personnel to travel by vehicle along roads throughout the geographic region to observe features and/or record information about them, for example. Also, remote sensing, such as aerial or satellite photography, can be used. In one embodiment, the data can include incident reports which can then be designated as ground truths for training a machine learning classifier to classify a traffic from probe data. Different sources of the incident report can be treated differently. For example, incident reports from municipal sources and field personnel can be treated as ground truths, while crowd-sourced reports originating from the general public may be excluded as ground truths.

The geographic database 207 can be a master geographic database stored in a format that facilitates updating, maintenance, and development. For example, the master geographic database 207 or data in the master geographic database 207 can be in an Oracle spatial format or other spatial format, such as for development or production purposes. The Oracle spatial format or development/production database can be compiled into a delivery format, such as a geographic data files (GDF) format. The data in the production and/or delivery formats can be compiled or further compiled to form geographic database products or databases, which can be used in end user navigation devices or systems.

For example, geographic data is compiled (such as into a platform specification format (PSF) format) to organize and/or configure the data for performing navigation-related functions and/or services, such as route calculation, route guidance, map display, speed calculation, distance and travel time functions, and other functions, by a navigation device, such as by a UE 209, for example. The navigation-related functions can correspond to vehicle navigation, pedestrian navigation, or other types of navigation. The compilation of the mapping and/or probe data to produce the end user databases can be performed by a party or entity separate from the map developer. For example, a customer of the map developer, such as a navigation device developer or other end user device developer, can perform compilation on a received geographic database in a delivery format to produce one or more compiled navigation databases.

As mentioned above, the geographic database 207 can be a master geographic database, but in alternate embodiments, the geographic database 207 can represent a compiled navigation database that can be used in or with end user devices (e.g., UE 209) to provide navigation-related functions. For example, the geographic database 207 can be used with the end user device UE 209 to provide an end user with navigation features. In such a case, the geographic database 207 can be downloaded or stored on the end user device UE 209, such as in applications 211, or the end user device UE 209 can access the geographic database 207 through a wireless or wired connection (such as via a server and/or the communication network 203), for example.

In one embodiment, the end user device or UE 209 can be an in-vehicle navigation system, a personal navigation device (PND), a portable navigation device, a cellular telephone, a mobile phone, a personal digital assistant (PDA), a watch, a camera, a computer, and/or other device that can perform navigation-related functions, such as digital routing and map display. In one embodiment, the navigation device UE 209 can be a cellular telephone. An end user can use the device UE 209 for navigation functions such as guidance and map display, for example, and for determination of traffic information along the one or more travel segments, according to exemplary embodiments.

Figure 3:
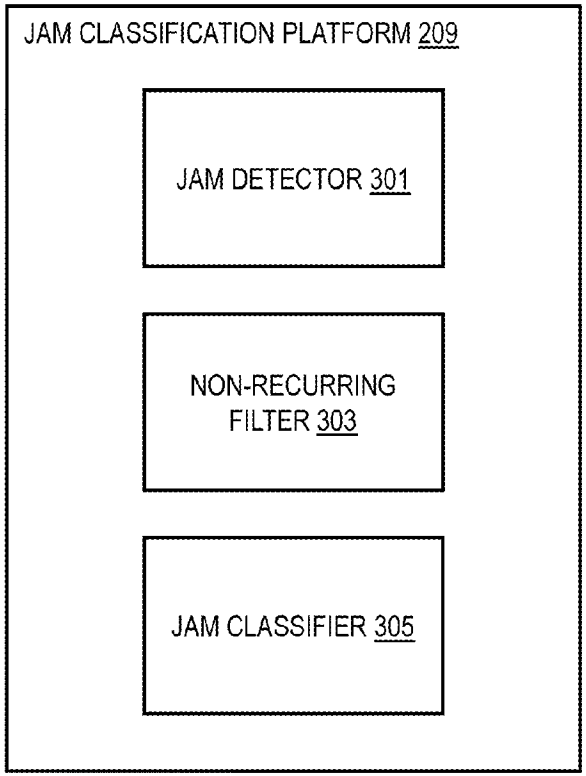
FIG. 3 is a diagram of the components of a jam classification platform, according to one embodiment.

FIG. 3 is a diagram of the components of the jam classification platform 205, according to one embodiment. By way of example, the jam classification platform 205 includes one or more components for detecting and classifying a traffic jam from probe data. It is contemplated that the functions of these components may be combined in one or more components or performed by other components of equivalent functionality. In this embodiment, the jam classification platform 205 includes: (1) a jam detector 301 for detecting all traffic jams 101, regardless of whether they are recurring or non-recurring; (2) a non-recurring filter 303 for identifying the non-recurring traffic jams 105 detected by the jam detector 301; and (3) a jam classifier 305 for classifying the types of traffic jams 101 detected by the jam detector 301 (e.g., non-recurring jams 105 caused by accidents 111). In one embodiment, the individual outputs of any of the three components 301-305 can be used to improve transportation management (e.g., generating improved navigation instructions to divert drivers around a detected jam 101) or to provide improved traveler information (e.g., presenting more accurate or improved estimated times of arrival if traveling on a roadway affected by a jam 101).

In one embodiment, the jam detector 301 can implemented using a method described in U.S. Ser. No. 14/629,628 (incorporated by reference herein in its entirety) as summarized further below. It is noted that the jam detection method of U.S. Ser. No. 14/629,628 is provided as only one example method for detecting a traffic jam 101. It is contemplated that any method capable of identifying a traffic jam in a distance-time space from probe data can be used. For example, travel speed of the probes as determined from the probe data can be visually represented so that a speed range is represented using different colors (e.g. a probe point can be color coded green if greater than 45 mph, yellow if between 20 mph and 45 mph, and red if below 20 mph). The color-coded probe point can then be plotted across distance and time to form an image. Then an image analysis to identify areas of red (e.g., corresponding to jam areas) to detect traffic jams 101.

Returning to the example implementation of the jam detector 301 using the method of U.S. Ser. No. 14/629,628, the jam detector 301 determines that there is a traffic jam 101 on a roadway at a time t if the average traffic speed (as determined from probe data) in a portion of the roadway at time t is lower than a certain threshold called the jam threshold. In one embodiment, this parameter is set according to user requirements, e.g., below what fraction of free-flow speed does a traffic management center or other user want to be alerted. The jam detector 301 detects traffic jams 101 online, meaning that at any point in time the jam detector 301 looks at the probe data that has been received up to that time. When a traffic jam 101 is detected, the jam detector 301 reports its start location (e.g., wherein the congestion starts to form) and end location (e.g., a further location where the traffic starts to recover to the normal or expected speed).

As previously described, in one embodiment, a probe point includes five attributes, namely, probe_id, longitude, latitude, speed, and time. The probe points are map matched to roadways before they are further processed. In one embodiment and as discussed herein, the location of a roadway are described in terms of the route distance along the roadway from a starting point. As a result, each probe point map-matched to a roadway or lane of the roadway corresponds to a point in a two-dimensional (2D) space wherein one axis is the time (e.g., corresponding to when the probe point was determined) and the other axis is the route distance with respect to the roadway or lane of the roadway. This 2D space can be called a distance-time space (e.g., see FIG. 8 for an example of a probe-point plot in a distance-time space where a probed point is shaded according to its speed attribute or feature).

In one embodiment, the jam detector 301 operates as follows. The distance dimension is evenly partitioned into m sections. A time window of width T slides along the time axis with the step size equal to $\delta$ (e.g., see FIG. 7 for description of the process). At each sliding step k (k=1, 2, 3, . . . ), the probe points that fall into the time window are used for traffic jam detection. Specifically, each distance section is assigned a speed which is the trimmed mean of all the probe points falling in that section. In the case that a section is empty, the speed of the adjacent upstream section is carried over. Then moving average is performed along the distance axis to generate a smoothed speed curve. The jam detector 301 tracks the change of speed curve following the positive direction of the distance axis. If a speed curve drops below the jam threshold at section i and remains so for n consecutive sections, the jam detector 301 outputs that a jam ends at the i-th section. In one embodiment, n is a parameter of the algorithm to deal with noise. If the speed curve becomes higher than the jam threshold at section j and remains so for n consecutive cells, the jam detector 301 outputs that the jam starts at the j-th section. In one embodiment, the triple <k, l, j> is a jam slice.

In an online, real-time, or continuous batch basis, each jam slice corresponds to a rectangular region in the distance-time space with the distance dimension ranging from the end location to the start location of the jam slice and the time range being the time window at which the jam slice is detected. Given a jam slice S1 at time step i and a jam slice S2 at time step j. The jam detector 301 designates that S1 immediately follows S2 if j=i+1. In one embodiment, a jam group is a sequence of jam slices in ascending order of time step such that each jam slice immediately follows its precedent. A jam group has a head which is the first jam slice in the sequence and a tail which is the last jam slice in the sequence. In one embodiment, a jam group also has a distance range which is the union of the distance ranges of all the jam slices in the group. Given a jam group G and a jam slice S, the jam detector 301 designates that S develops G if S immediately follows the tail of G and the distance range of S overlaps that of G. In other words, S develops G means that S is a development in distance and time of the congestion represented by G.

In one embodiment, jam groups are formed and maintained as follows:

(1) When a jam slice S is detected, determine whether S develops at least one exist jam group. If so, add S to each jam group that it develops and update the tail and the distance range of the developed jam group accordingly. Otherwise, (2) S creates a new jam group.

(3) If the number of jam slices in a jam group reaches a value called candidate size, then the jam group is called a candidate group and is supplied to the non-recurring filter 303 and/or the jam classifier 305 for classification.

In one embodiment, each candidate group has a jam area and, in certain embodiments, a downstream area. In one embodiment, the jam area is the union of the jam slices in the group. To define the downstream area, a downstream slice of a jam slice can first be defined. For example, the downstream slice of a jam slice is a rectangular region in the distance-time space with the distance dimension ranging from the start location of the jam slice to a location that is L distance units downstream. The time range of the downstream slice is the same as that of its jam slice. In one embodiment, L is a system parameter and can be set by a user (e.g., set to 2.5 km). In one embodiment, the downstream area of a jam slice is the union of the downstream slices of each jam slice.

In one embodiment, the non-recurring filter 303 and jam classifier 305 can then work individually or together to classify detected jams 101. For example, the non-recurring filter 303 can use a machine learning classifier or other criteria to distinguish between recurring jams 101 and non-recurring jams 105. In this case, the classifier used by the non-recurring filter 303 is trained with ground truths established for recurring and non-recurring causes of the traffic jams 101. In one embodiment, the jam classifier 305 is a classifier that is trained using ground truths for different types of non-recurring jams 105 (e.g., accidents, breakdowns, traffic waves, load spills, etc.). In either case, the process of classification is similar and described below.

Typically, when a non-recurring incident occurs, different patterns of features of the resulting traffic conditions in the jam area and/or the downstream area can be indicative of the different causes. For example, in when an accident 111 occurs, the vehicles upstream of the accident should be in a slow-moving queue and when they pass the accident they should speed up to normal driving speed or even free-flow speed. Accordingly, a classifier may find (e.g., after training) that an accident 111 could be characterized by low speed and high density in the jam area. In embodiments where the downstream area is also considered, the classifier may that the accident 111 could be further classified by high speed and low density in the downstream area as indicated by observed probe data. In one embodiment, to distinguish accidents from recurring traffic jams, the normalized speed may also be considered. For example, the observed speed can be normalized against the normal or expected speed for the roadway at a given time. In addition, since the accident location is fixed, there should be a clear border between the jam area and the downstream area. These features can be observed or extracted from the probe data using the processes discussed with respect to the various embodiments described herein.

For example, both the non-recurring filter 303 classifier and the jam classifier 305 can the following probe data features for classification (example features provided as illustration and not as limitations):

Jam normalized speed: The average normalized speed in the jam area.

Jam speed: The average speed in the jam area.

Jam probe point density: The density of probe points in the jam area.

Jam probe_id density: The density of distinct proble_ids in the jam area.

Downstream normalized speed: The average normalized speed in the downstream area.

Downstream speed: The average speed in the downstream area.

Downstream probe point density: The density of probe points in the downstream area.

Downstream probe_id density: The density of distinct probe_ids in the downstream area.

Downstream jam speed ratio: The ratio between the downstream speed and the jam speed.

Downstream jam probe point density ratio: The ratio between the downstream probe point density and the jam probe point density.

Downstream jam probe_id density ratio: The ratio between the downstream probe_id density and the jam probe_id density.

Variance of jam-downstream border: The variance of the end locations of the jam slices.

Jam length: The average distance range of the jam slices.

In one embodiment, the features determined from the probe data can be further processed to eliminate potential outliers. For example, the average values of the features above can be 25% trimmed averages to deal with outliers. It is contemplated that any outlier culling process or no outlier process at all may be used by the jam classification platform 205.

In one embodiment, the non-recurring filter 303 and/or the jam classifier 305 are machine language classifiers trained using ground truths about traffic jams 101 occurring on observed roadways. To establish ground truths for training, probe data can collected from a representative set of roadways for a time period. During this time period, ground truth observations about traffic incidents (both recurring and non-recurring incidents) and resulting jams can be collected. In one embodiment, the ground-truth data can be retrieved from a variety of data sources such as incident reports from municipal authorities, incident reports collected by map service providers, crowd-sourced incident reports (depending on desired reliability of reporting data). For example, such incident reports may have information to indicate an incident type (e.g., accident, disabled vehicle, construction, spilled load, traffic wave, etc.), start and end times for the incident, start and end locations for the incident, etc.

In one embodiment, the classifier training process includes creating positive and negative examples of different types of traffic jams 101 to be classified. For example, when detecting traffic jams resulting from accidents 111, the positive examples can probe data candidate groups that match accident reports. In one embodiment, the ground-truth with respect to accident can be determined if multiple reporting authorities indicate the same accident 111 at the same place and time. A candidate group is labeled as a positive example if its location (e.g., in the distance-time space) matches a ground-truth incident (e.g., accident 111 or another other type of incident).

In one embodiment, the non-recurring filter 303 and/or the jam classifier 305 can apply any number rules. For example, one rule can label all non-positive candidate groups as negative examples. In one embodiment, another rule can be applied whereby a candidate group is labeled as a negative example only if it does not match any event reported by any reporting authority queried by the jam classification platform 205.

In example use case, the jam non-recurring filter 303 and/or the jam classifier 305 can use the following rules for determining positive examples and negative examples for training data: (1) positive example—a candidate group that matches an incident report reported by multiple reporting authorities; and (2) negative example—a candidate group that does not match any event reported by any of the queried reporting authorities.

In one embodiment, when using such rules, it can be common to have many more negative examples than positive examples. In response, the non-recurring filter 303 and/or the jam classifier 305 can adopt a cost-sensitive learning approach to deal with an unbalanced training set. In cost-sensitive learning, when computing the accuracy of a classifier, more penalties are given to false negative errors, thus forcing the classifier not to classify all examples as negative.

An example of the system parameters and their values that can be used for training is provided below in Table 1:

TABLE 1

| | | | |
|---|---|---|---|
| jam threshold | 25 km/h | time window width | 15 minutes |
| distance section length | 2500 meter | time window sliding step size | 5 minutes |
| distance moving average step size | 500 meter | noise tolerance | 0 |
| downstream area length | 2500 meter | candidate size | 5 (unless specified otherwise) |
| cell size for profile building | 60 seconds × 100 meters | smoothing window for profile building | 300 seconds × 500 meters |

In one embodiment, to obtain a robust classifier, various machine learning methods can be used alone or in combination. By of example, machine learning method for training the non-recurring filter 303 and/or the jam classifier 305 include, but are not limited to, any combination of Neural Networks (NN), Decision Trees (J48), Random Forests (RF), and Naïve Bayesian (NB).

In one embodiment, the most indicative features can be determined by using, e.g., Weka Information Gain or other similar process. In one example use case, probe data collected from a typical highway may indicate the following most indicative features for incident that is an accident 111: (1) downstream jam speed ratio, (2) jam normalized speed, (3) jam speed, (4) downstream jam probe_id density ratio, and/or (5) downstream speed.

In one embodiment, to select the best model for classifying a traffic jam from probe data, the jam classification platform 205 can evaluate the models according to both a full set of features as well as just the most indicative sub feature set using the various machine learning methods and tested by, for instance, cross validation and unseen data. In one embodiment, the selection criteria for choosing the best model(s) are that (1) the accuracy is high, and (2) the accuracy should be stable between cross validation and unseen data to avoid overfitting. For example, in an example data set, Random Forests with full feature set may be the best model. In yet another embodiment, the jam classification platform 205 can also evaluate whether probe data from just the jam area, just the downstream area, or both the jam area and the downstream area can be used to train the models.

In one embodiment, when testing the non-recurring filter 303 and/or the jam classifier 305, the testing can distinguish between different cases that may potentially confuse a classifier. For example, with respect to an accident classifier, two cases depending on whether jam slices at interchanges are taken into account can be used. The reason is that traffic jams 101 at some interchanges have similar patterns as accidents 111 due to redistribution of traffic. Specifically, when a lot of traffic from upstream is distributed to other highways or roadways connected by an interchange, there can be an abrupt increase of traffic speed and decrease of traffic density downstream. This pattern is similar to that of accidents. Furthermore, such traffic jams 101 are not always recurring and therefore may not be canceled by normalization.

In one embodiment, the non-recurring filter 303 and/or the jam classifier 305 can be trained specifically for each individual roadway or can be trained to be generally applicable to all roadways. For scaling purposes, it is desirable to have a single classifier that works for every roadway. In one embodiment, a cross-test by applying a trained classifier built for one roadway to another roadway. In addition or alternatively, a general jam classifier can be built using a combination of training data from multiple roadways (e.g., three or more roadways) and then applied to a different roadway for validation. In one embodiment, classifiers able achieve a desired level of performance or accuracy during cross-validation can be candidates for use as general traffic jam classifiers.

In one embodiment, response time for classifying a traffic jam from probe data can be dependent on the candidate size, time step size, and time windows width used for determining candidate groups for processing. This is because the longer the response time, the more evidence (e.g. probe data) is collected by the jam classifier, and therefore the classifier is more reliable. In one embodiment, the jam classification platform 205 can vary the response time and monitor the resulting accuracy to determine an optimal response time to configure a classifier. For example, while accuracy generally increases with response time, there can be a plateau in the increase in accuracy as response times increase. For example, an example data set may indicate that response accuracy improves with response time when the response time is below 17.5 minutes; beyond that point, the accuracy increases only slightly. Accordingly, the jam classifier may use the 17.5 minute response time to provide the best trade-off between the detection delay and the classification accuracy. It is noted that 17.5 minutes is provided only as an example and that a response time can be dynamically determined from a training data set.

In one embodiment, the non-recurring filter 303 and/or the jam classifier 305 can then be used to classify actual probe data following training, model selection, and/or model validation. In one embodiment, the results of the classification can be used to improve navigation and information awareness for drivers.

In one embodiment, the non-recurring filter 303 and/or the jam classifier 305 can be trained at lane level by treating each individual lane as a separate highway way. Then, the non-recurring filter 303 and/or the jam classifier 305 can be applied to each lane of a highway. A lane or a set of lanes that has the highest confidence of accident detection are determined to be the lane(s) where an accident occurs. (This procedure requires that the classification model outputs a confidence value alone with the classification result, which is supported by most of the existing machine learning techniques.)

Figure 4:
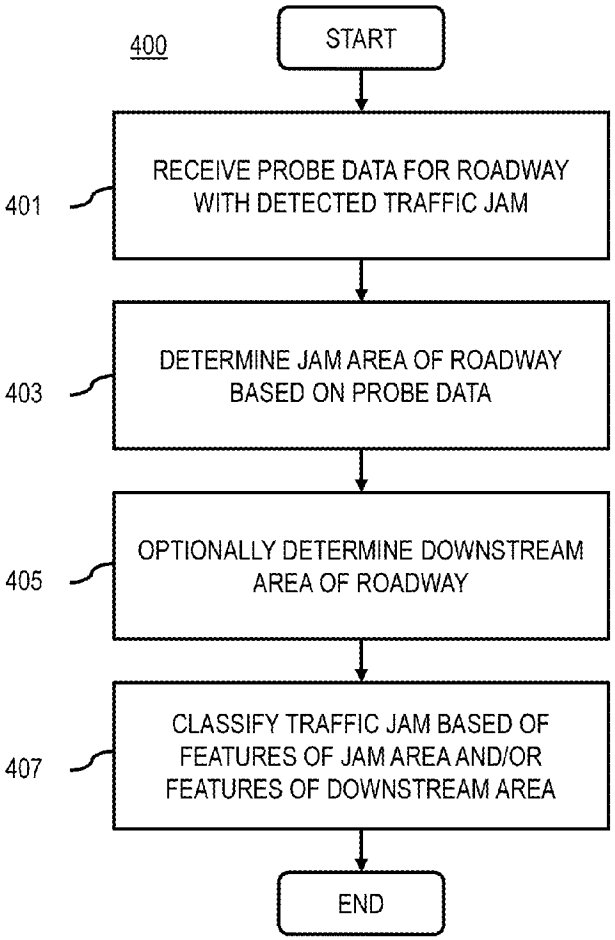
FIG. 4 is a flowchart of a process for classifying a traffic jam from probe data, according to one embodiment.
Figure 10:
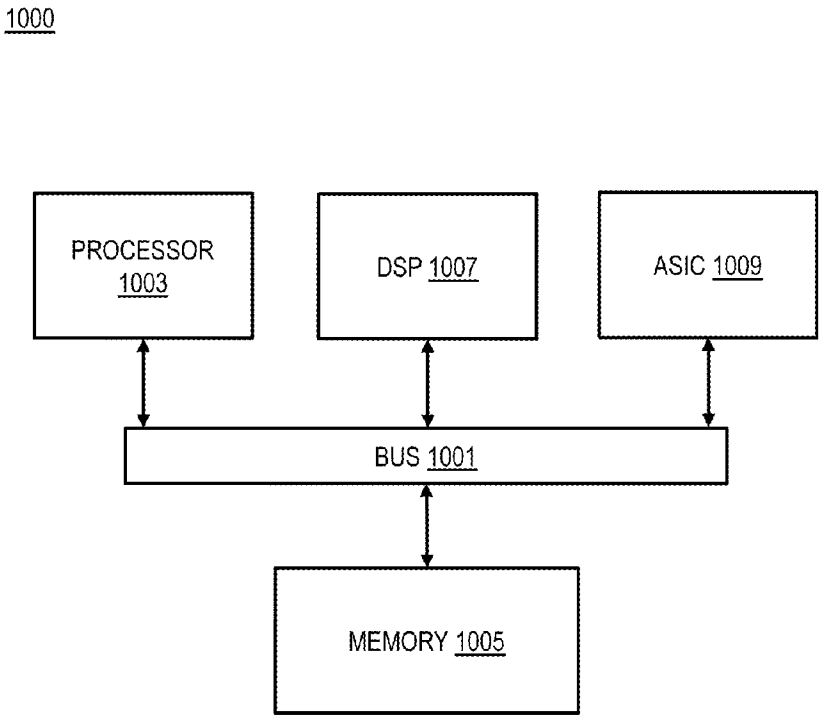
FIG. 10 is a diagram of a chip set that can be used to implement an embodiment of the invention.

FIG. 4 is a flowchart of a process for classifying a traffic jam from probe data, according to one embodiment. In one embodiment, the jam classification platform 205 performs the process 400 and is implemented in, for instance, a chip set including a processor and a memory as shown in FIG. 10.

In step 401, the jam classification platform 205 receives probe data that is map-matched to a roadway on which a traffic jam 101 is detected. In one embodiment, the probe data is collected from one or more probe points corresponding to one or more vehicles traveling the roadway or a lane of a multi-lane roadway. In one embodiment, the jam classification platform 205 can operate in an offline mode in which an entire probe data set can collected (e.g., over a one month or one week period) and classified. This type of classification can provide information on historical traffic classifications if real-time or online detection is not needed or desired.

In another embodiment, the jam classification platform 205 can operate in an online mode in which classification results can be generated continuously as data is received. By batching or grouping the probe data into time slices, classification results can be provided in a real-time or pseudo-real-time manner. The online or batch process is described in further detail below with respect to FIG. 5.

In step 403, the jam classification platform 205 determines a jam area of the roadway based on the probe data. In one embodiment, the jam area corresponds to one or more segments of the roadway affected by the traffic jam. In one embodiment, the detection of the jam area can be performed as part of the jam detection process previously described (e.g., using the method of U.S. Ser. No. 14/269,629).

In step 405, the jam classification platform 205 optionally determines a downstream area of the roadway. In one embodiment, the downstream area corresponds to one or more other segments of the roadway downstream from the jam area. In one embodiment, the downstream area includes an area of a predetermined distance downstream from the jam area. As previously described, the length or area of the downstream area can be a fixed system parameter (e.g., 2.5 km downstream from the jam area). In addition or alternatively, the downstream area can be determined using a dynamic algorithm (e.g., probe speed or density criteria) or specify a distance to a next detected incident or jam downstream from the current jam.

In step 407, the jam classification platform 205 classifies, using a machine learning classifier, the traffic jam as either a recurring traffic jam or a non-recurring traffic jam based on a first set of features determined from a portion of the probe data collected from the jam area and/or a second set of features determined from another portion of the probe data collected from the downstream area. In other words, the jam classification platform 205 can perform its classification based on just the probe data collected from the jam area, just the probe data collected from the downstream area, or probe data collected from both areas. In one embodiment, the first set of features includes a jam normalized speed, a jam speed, a jam probe point density, a density of distinct probe points in the jam area, or a combination thereof. In one embodiment, the second set of features includes a downstream normalized speed, a downstream speed, a downstream probe point density, a density of distinct probe points in the downstream area, a ratio of the downstream stream speed to a jam speed, a ratio of the downstream point density to a jam probe point density, a ratio of the density of distinct probe points in the downstream area to a density of the distinct probe points in the jam area, a variance of a jam-downstream border, a jam length, or a combination thereof. It is contemplated that the features or attributes described as the first set or second set are interchangeable. For example, the two sets can be selected from the same common pool of features of attributes of the probe date. In addition, the lists above are provided only as examples and not as limitations. It is contemplated that any feature or attribute that can be collected by a vehicle or probe can be reported in a probe point or probe data.

In one embodiment, the jam classification platform 205 classifies the non-recurring traffic jam as an accident-caused traffic jam based on the first set of features and/or the second set of features. As discussed above, the jam classification platform 205 can first classify whether a traffic jam is recurring or non-recurring, and then further classify the non-recurring jams according to more specific causes. For example, because accidents are relatively common and can create significant traffic disruption, accident classification is an area of interest. However, it is contemplated that the classifier can be applied to classifying any type or cause of non-recurring traffic jam if the training data (e.g., with ground truths) are available to train the jam classifier.

In one embodiment, the jam classification platform 205 classifies a severity level of the traffic jam based on the first set of features and the second set of features. In addition to the type of incident (e.g., accident), the machine learning classifier of the jam classification platform 205 can be further trained to determine a severity level of the impact of the incident on travel delays or other traffic disruptions. In yet another embodiment, the jam classification platform 205 classifies the traffic jam based on the lane of the roadway in which the jam is detected. In other words, in one embodiment, the roadway referred to in the embodiments described herein can represent one or more lanes of a multi-lane roadway. Then the classifying of the traffic jam can indicate on which of the one or more lanes of the multi-lane roadway the traffic jam is detected. For example, a minor single car accident occurring in the shoulder lane may show different patterns of probe data features (e.g., less severe slow down, followed by more rapid increase in acceleration following the accident) versus a more sever multi-car accident blocking a travel lane (e.g., more severe slow down, followed by a slower increase of acceleration following the accident due to increased "rubber-necking" by vehicles caught in the traffic disruption). It is contemplated that the severity level can be expressed using, for instance, any number of categories or degrees of severity (e.g., low severity, medium severity, high severity, etc.).

In one embodiment, the jam classification platform 205 presents a result of the classifying of the traffic jam in a map user interface depicting the roadway. In addition or alternatively, the traffic jam classification results can be provided to third party traffic centers, governmental entities, or other organizations/services to use to broadcast information to end users. It is contemplated that the classification results can be used for any other purposes such as for analysis, monitoring, record-keeping, research, etc. As previously discussed, classification results can be used to advantageously provide more information to users of navigation systems or services by providing for more detailed, timely, and accurate information about an incident. In one embodiment, the results can also be used to provide more accurate estimated times of arrival (ETAs). In yet another embodiment, the classification results can be used to improve routing determinations to present to a driver. For example, a navigation system can be configured to route around accidents in a more timely and accurate manner to reduce travel time and potential for secondary accidents caused by traffic disruptions.

Figure 5:
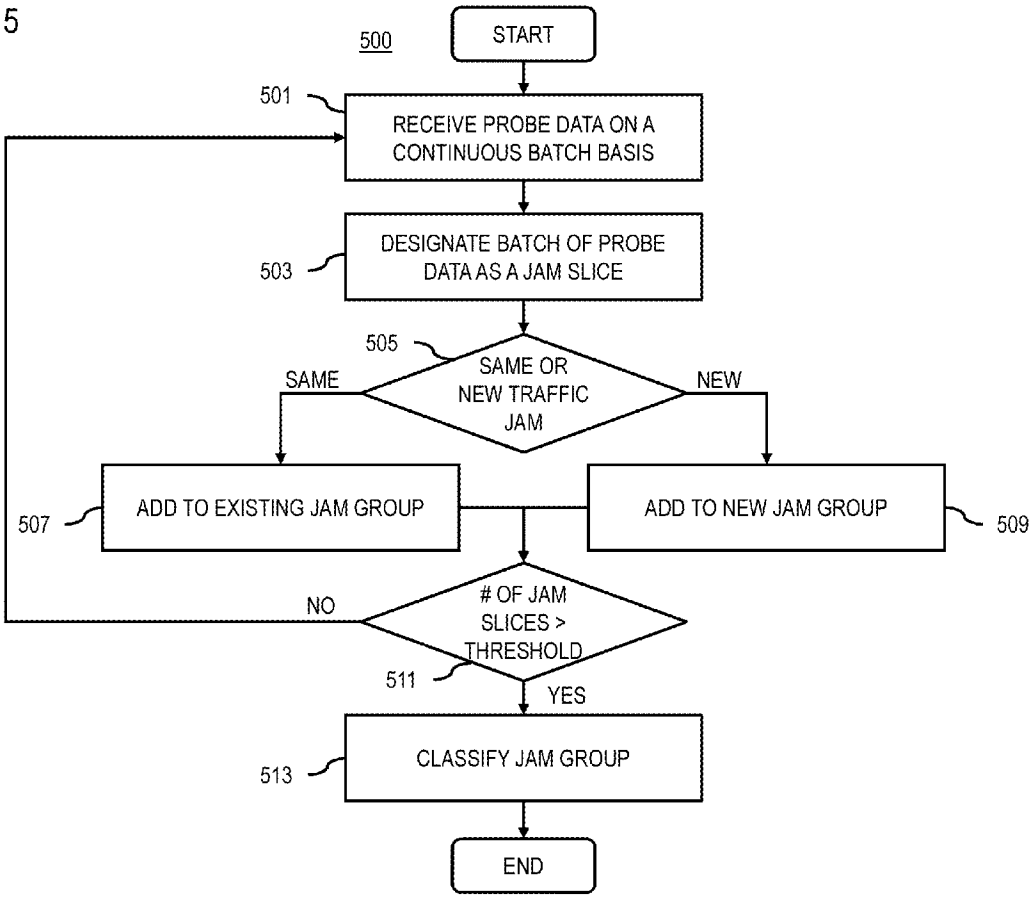
FIG. 5 is a flowchart of a process for processing probe data on a continuous batch basis to classify a traffic jam, according to one embodiment.

FIG. 5 is a flowchart of a process for processing probe data on a continuous batch basis to classify a traffic jam, according to one embodiment. In one embodiment, the jam classification platform 205 performs the process 500 and is implemented in, for instance, a chip set including a processor and a memory as shown in FIG. 10. The process 500 describes an embodiment of the jam classification platform 205 that can be performed on an online, real-time, or continuous basis.

In step 501, the jam classification platform 205 receives probe data from one or more vehicles traveling on a roadway with a detected traffic jam. In one embodiment, the probe data is received on a continuous batch basis in which a batch of the probe data is collected for a predetermined period of time before the batch is processed and a next batch of the probe data is collected for the same predetermined period of time.

In step 503, the jam classification platform 205 designates the batch of the probe data as a jam slice. By way of example, the batch is designated as a jam slice if a jam is detected in the slice using, e.g., the jam detecting process previously described. As part of the jam detection process, the jam area and the downstream area also determined.

In step 505, the jam classification platform 205 determines whether the jam slice relates to the same or new traffic jam. This determination, for instance, is based on identifying whether the jam areas overlap between jam slices.

In step 507, the jam classification platform 205 adds the jam slice to a jam group associated with the traffic jam if the jam slice relates to the traffic jam. In one embodiment, the classifying of the traffic jam is performed based on the jam group.

In step 509, the jam classification platform 205 creates a new jam group including the jam slice if the jam slice relates to another traffic jam.

In step 511, the jam classification platform 205 determines whether a count of the jam slices in the jam group reaches a candidate size value. As previously discussed the candidate size value or threshold represents the number or count of jam slices that are to be included in a group before the jam group is classified in step 513 below. Because a jam slice is represents a set of probe data collected for a predetermined period of time (e.g., 5 mins), increasing the candidate size value also increases the classification delay for the jam classification platform 205. For example, if a jam slice represents a 5 min period and the candidate size value or threshold is set to three slices, the response time for detecting and classifying a traffic jam is 15 mins (e.g., the minimum time needed to group three consecutive jam slices of 5 mins each). This response time, however, is balanced against the amount of probe data collected because increasing the candidate size value also results in increasing the amount of probe data available for processing. Generally, as discussed above, more probe data to classify can result in greater accuracy. Accordingly, the candidate size value or threshold can be set to balance response time (e.g., how quickly a classification result can be determined or reported) against a desired accuracy of the classification result.

In step 513, the jam classification platform 205 initiates the classifying of the traffic jam when a count of jam slices in the jam group reaches a candidate size value. Otherwise, the jam classification platform 205 continues to receive and process additional batches or jam slices until jam group reaches the candidate size value.

Figure 6:
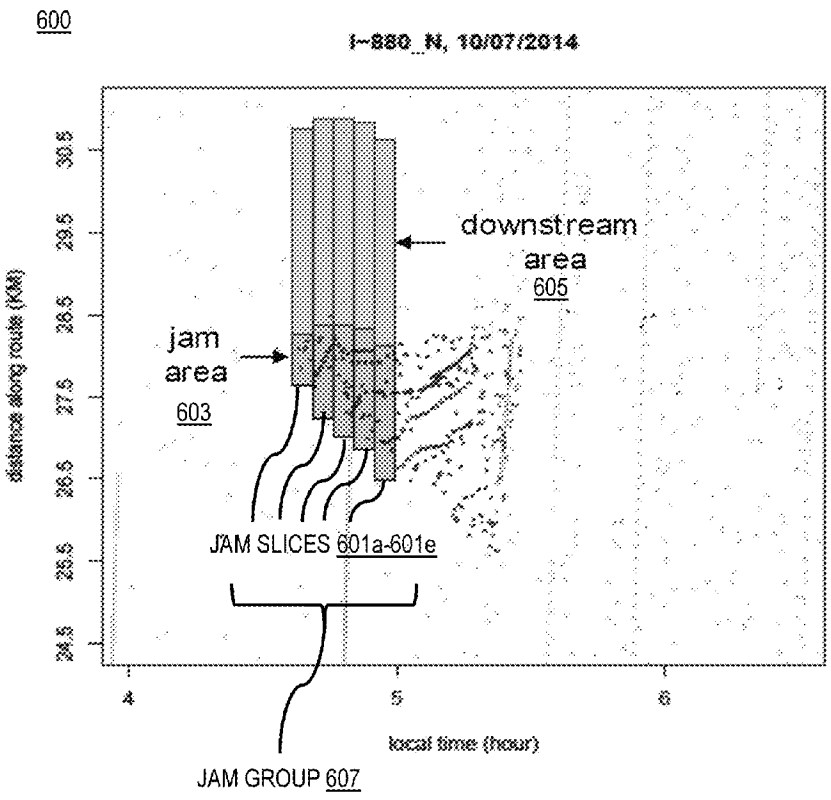
FIG. 6 is a diagram illustrating designation of jam areas and downstream areas for classifying a traffic jam, according to one embodiment.

FIG. 6 is a diagram illustrating designation of jam areas and downstream areas for classifying a traffic jam, according to one embodiment. The graph 600 depicts a set of probe data associated with a roadway affected by a traffic jam, wherein the probe data is plotted according to a distance-time space. The graph 600 illustrates a process whereby jam slices 601*a*-601*e* (also collectively referred to as jam slices 601) are collected as previously described. As shown, each jam slice 601 corresponds to a rectangular region in the distance-time space for a fixed window time that slides step wise in time.

In this example, as each batch of probe data is collected, the jam classification platform 205 processes the probe data to determine whether a jam is detected the distance-time space occupied by that batch of probe data. If a traffic jam is detected, the jam classification platform 205 designates the batch of probe data as a jam slice 601. For each jam slice 601, a jam area 603 and a downstream area 605 are determined. For example, jam slice 601*a* represents the head jam slice because this is the first jam slice 601*a* in which a traffic jam is detected. As the next jam slice 601*b* is detected, the respective jam area 603 of the new jam slice 601*b* is compared to the preceding jam slice 601*b*. If there is overlap, then the new jam slice 601*b* is added to the jam group 607. The process continues for each subsequent jam slice 601*c* to 601*e* until the candidate size value or threshold for the jam group 607 is reached (e.g., in this case, five jam slices 601).

In one embodiment, the candidate size parameter determines the response time (or the detection delay) of the traffic jam classifier. By way of example, the response time can be expressed as:

$$\text{Response Time}=(\text{candidate_size}-1)\times\text{time_step_size}+(\text{time_window_width}/2) \quad \text{a.}$$

It is noted that the larger the candidate size (count or number jam slices 601 needed to designate a jam group 607), the more evidence is collected and thus more reliable classification in general, but on the other hand the longer the response time.

Figure 7:
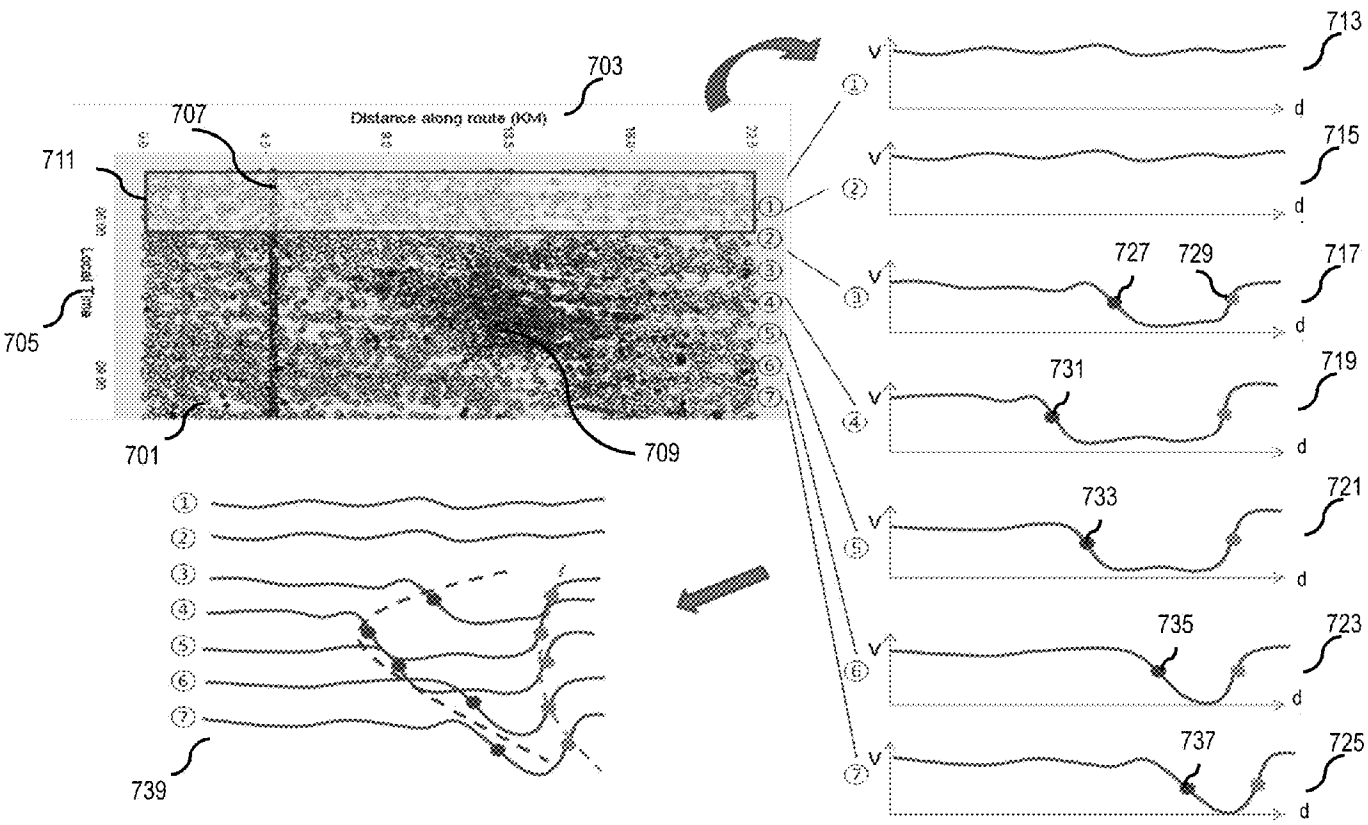
FIG. 7 is a diagram that represents a scenario wherein starting points and/or ending points for traffic jams are detected in travel segments, according to one example embodiment.

FIG. 7 is a diagram that represents a scenario wherein starting points and/or ending points for traffic jams are detected in travel segments, according to one example embodiment. The density and/or speed of the vehicles passing through travel segments may determine the traffic situation. In one scenario, the points 701 represent probe points (i.e., location points associated with the speed of vehicles travelling on the highway). The speed of vehicles may be represented in various manners, for example, darker probe points denote vehicles with slower speed whilst lighter probe points denote vehicles with higher speed. In one scenario, the X-axis 703 represents the distance along the at least one highway (e.g., the length of 22.5 kilometers) whereas the Y-axis 705 represents the time. The distance dimension is evenly partitioned into m sections. The X-axis and the Y-axis represents the speed of vehicles at a particular distance in a specific time.

In one example embodiment, traffic jam may occur at any location point in a highway segment (e.g., middle of the highway). Initially, there is no traffic jam (e.g., up till 6 a.m. there is no traffic jam because most of the probe points are lighter). The vertical straight line 707 at the distance of approximately 4.5 kilometers represents a tunnel, and since there is no signal, probe data could not be collected. Then, after 6 a.m. the traffic jam escalates as more vehicles starts to queue or slow down. The shaded area 709 represents the progression of a traffic jam. Basically, the traffic jam evolution or change is captured in real-time.

In one scenario, the sliding window (e.g., a rectangular box 711) evaluates the probe points when it slides and constructs the speed curve that represents the changes in traffic speed over the distance. A time window of width T slides along the time axis with the increment equal to δ. Each time after the time window slides, the probe points that fall into the time window are used for traffic jam detection. In one scenario, the sliding window is divided into numerous small pieces depending on the location to compute a moving average. Then, different curves (e.g., 713, 715, 717, 719, 721, 723, and 725) representing the traffic speed variations over a highway segment of 22.5 kilometers during a series of time windows are generated. In one scenario, curves 713 and 715 are stable and there is no abrupt change or a drop in the speed. However, in curve 717 there is a sudden drop in speed as represented by point 727, this drop may be bigger than some threshold (e.g., if the speed drops to 5 mph due to a traffic jam).

Specifically, each distance section is assigned a speed which is the average of all probe points falling into the section, and if a section is empty, the speed of the adjacent upstream section is taken. Then, moving average is performed along the distance dimension to generate a smoothed speed curve. The point 727 may represent the starting point of the traffic jam in a road segment whilst the point 729 may represent the ending point for a traffic jam in a road segment. The jam classification platform 205 tracks the change of speed curve. When a speed curve drops below the jam threshold, the algorithm outputs that a jam starts at the current section. In another time window, in curve 719 the start point 731 propagates back indicating an increasing trend in the traffic jam. In another time window, at curves 721, 723 and 725, the start points 733, 735, and 737 starts to retrieve as the traffic gains momentum. When the speed curve becomes higher than the jam speed for n consecutive cells, the algorithm outputs that the jam ends at the n-th section. Then, n is a parameter to tolerate noise pikes. Subsequently, these curves are assembled 739 to clearly show the movement of traffic jam in a certain time period in a road segment, and also to generate a trend curve.

Figure 8:
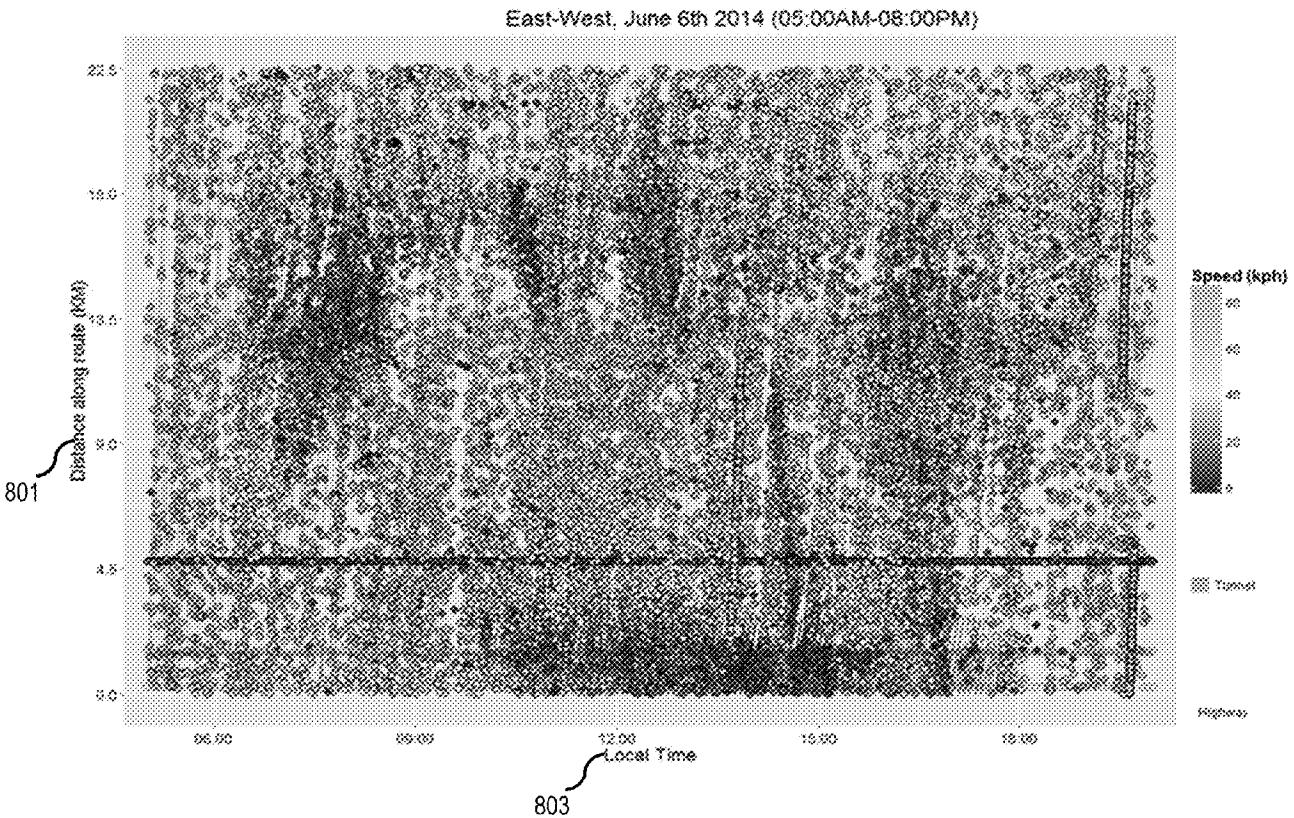
FIG. 8 is a diagram that represents a scenario wherein probe data are used to detect traffic jams, according to one example embodiment.

FIG. 8 is a diagram that represents a scenario wherein probe data are used to detect traffic jams, according to one example embodiment. The probe data used in analyzing the traffic jams are provided by connected driving. In one scenario, the jam classification platform 205 may cause a plotting of speed curves based, at least in part, on certain thresholds. For example, the distance section length m may be set to 500 meters, the time window width T may be set to 15 minutes, the sliding increment δ may be set to 5 minutes, the noise tolerance n may be set to 4, and the jam threshold may be set to 25 kilometer per hour (kph). In another scenario, the jam classification platform 205 may cause a color representation of at least one highway segment 801 based, at least in part, on speed information associated with one or more vehicles during various time frame 803. The darker probe points represent vehicles with slower speed whilst lighter probe points represent vehicles with higher speed.

The processes described herein for providing classifying a traffic jam from probe data may be advantageously implemented via software, hardware (e.g., general processor, Digital Signal Processing (DSP) chip, an Application Specific Integrated Circuit (ASIC), Field Programmable Gate Arrays (FPGAs), etc.), firmware or a combination thereof. Such exemplary hardware for performing the described functions is detailed below.

Figure 9:
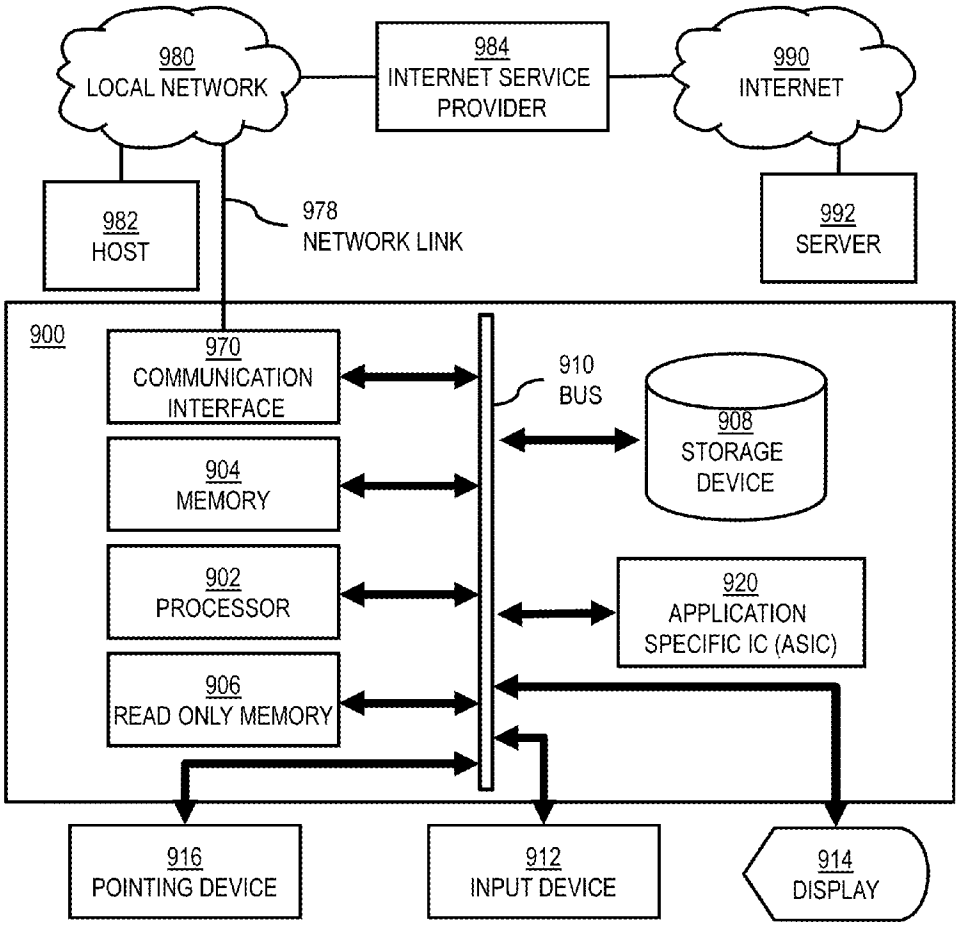
FIG. 9 is a diagram of hardware that can be used to implement an embodiment of the invention.

FIG. 9 illustrates a computer system 900 upon which an embodiment of the invention may be implemented. Computer system 900 is programmed (e.g., via computer program code or instructions) to classify a traffic jam from probe data as described herein and includes a communication mechanism such as a bus 910 for passing information between other internal and external components of the computer system 900. Information (also called data) is represented as a physical expression of a measurable phenomenon, typically electric voltages, but including, in other embodiments, such phenomena as magnetic, electromagnetic, pressure, chemical, biological, molecular, atomic, sub-atomic and quantum interactions. For example, north and south magnetic fields, or a zero and non-zero electric voltage, represent two states (0, 1) of a binary digit (bit). Other phenomena can represent digits of a higher base. A superposition of multiple simultaneous quantum states before measurement represents a quantum bit (qubit). A sequence of one or more digits constitutes digital data that is used to represent a number or code for a character. In some embodiments, information called analog data is represented by a near continuum of measurable values within a particular range.

A bus 910 includes one or more parallel conductors of information so that information is transferred quickly among devices coupled to the bus 910. One or more processors 902 for processing information are coupled with the bus 910.

A processor 902 performs a set of operations on information as specified by computer program code related to classifying a traffic jam from probe data. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 910 and placing information on the bus 910. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 902, such as a sequence of operation codes, constitute processor instructions, also called computer system instructions or, simply, computer instructions. Processors may be implemented as mechanical, electrical, magnetic, optical, chemical or quantum components, among others, alone or in combination.

Computer system 900 also includes a memory 904 coupled to bus 910. The memory 904, such as a random access memory (RAM) or other dynamic storage device, stores information including processor instructions for classifying a traffic jam from probe data. Dynamic memory allows information stored therein to be changed by the computer system 900. RAM allows a unit of information stored at a location called a memory address to be stored and retrieved independently of information at neighboring addresses. The memory 904 is also used by the processor 902 to store temporary values during execution of processor instructions. The computer system 900 also includes a read only memory (ROM) 906 or other static storage device coupled to the bus 910 for storing static information, including instructions, that is not changed by the computer system 900. Some memory is composed of volatile storage that loses the information stored thereon when power is lost.

Also coupled to bus 910 is a non-volatile (persistent) storage device 908, such as a magnetic disk, optical disk or flash card, for storing information, including instructions, that persists even when the computer system 900 is turned off or otherwise loses power.

Information, including instructions for classifying a traffic jam from probe data, is provided to the bus 910 for use by the processor from an external input device 912, such as a keyboard containing alphanumeric keys operated by a human user, or a sensor. A sensor detects conditions in its vicinity and transforms those detections into physical expression compatible with the measurable phenomenon used to represent information in computer system 900. Other external devices coupled to bus 910, used primarily for interacting with humans, include a display device 914, such as a cathode ray tube (CRT) or a liquid crystal display (LCD), or plasma screen or printer for presenting text or images, and a pointing device 916, such as a mouse or a trackball or cursor direction keys, or motion sensor, for controlling a position of a small cursor image presented on the display 914 and issuing commands associated with graphical elements presented on the display 914. In some embodiments, for example, in embodiments in which the computer system 900 performs all functions automatically without human input, one or more of external input device 912, display device 914 and pointing device 916 is omitted.

In the illustrated embodiment, special purpose hardware, such as an application specific integrated circuit (ASIC) 920, is coupled to bus 910. The special purpose hardware is configured to perform operations not performed by processor 902 quickly enough for special purposes. Examples of application specific ICs include graphics accelerator cards for generating images for display 914, cryptographic boards for encrypting and decrypting messages sent over a network, speech recognition, and interfaces to special external devices, such as robotic arms and medical scanning equipment that repeatedly perform some complex sequence of operations that are more efficiently implemented in hardware.

Computer system 900 also includes one or more instances of a communications interface 970 coupled to bus 910. Communication interface 970 provides a one-way or two-way communication coupling to a variety of external devices that operate with their own processors, such as printers, scanners and external disks. In general the coupling is with a network link 978 that is connected to a local network 980 to which a variety of external devices with their own processors are connected. For example, communication interface 970 may be a parallel port or a serial port or a universal serial bus (USB) port on a personal computer. In some embodiments, communications interface 970 is an integrated services digital network (ISDN) card or a digital subscriber line (DSL) card or a telephone modem that provides an information communication connection to a corresponding type of telephone line. In some embodiments, a communication interface 970 is a cable modem that converts signals on bus 910 into signals for a communication connection over a coaxial cable or into optical signals for a communication connection over a fiber optic cable. As another example, communications interface 970 may be a local area network (LAN) card to provide a data communication connection to a compatible LAN, such as Ethernet. Wireless links may also be implemented. For wireless links, the communications interface 970 sends or receives or both sends and receives electrical, acoustic or electromagnetic signals, including infrared and optical signals, that carry information streams, such as digital data. For example, in wireless handheld devices, such as mobile telephones like cell phones, the communications interface 970 includes a radio band electromagnetic transmitter and receiver called a radio transceiver. In certain embodiments, the communications interface 970 enables connection to the communication network 203 for classifying a traffic jam from probe data.

The term computer-readable medium is used herein to refer to any medium that participates in providing information to processor 902, including instructions for execution. Such a medium may take many forms, including, but not limited to, non-volatile media, volatile media and transmission media. Non-volatile media include, for example, optical or magnetic disks, such as storage device 908. Volatile media include, for example, dynamic memory 904. Transmission media include, for example, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, any other memory chip or cartridge, a carrier wave, or any other medium from which a computer can read.

FIG. 10 illustrates a chip set 1000 upon which an embodiment of the invention may be implemented. Chip set 1000 is programmed to classify a traffic jam from probe data as described herein and includes, for instance, the processor and memory components described with respect to FIG. 9 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set can be implemented in a single chip.

In one embodiment, the chip set 1000 includes a communication mechanism such as a bus 1001 for passing information among the components of the chip set 1000. A processor 1003 has connectivity to the bus 1001 to execute instructions and process information stored in, for example, a memory 1005. The processor 1003 may include one or more processing cores with each core configured to perform independently. A multi-core processor enables multiprocessing within a single physical package. Examples of a multi-core processor include two, four, eight, or greater numbers of processing cores. Alternatively or in addition, the processor 1003 may include one or more microprocessors configured in tandem via the bus 1001 to enable independent execution of instructions, pipelining, and multithreading. The processor 1003 may also be accompanied with one or more specialized components to perform certain processing functions and tasks such as one or more digital signal processors (DSP) 1007, or one or more application-specific integrated circuits (ASIC) 1009. A DSP 1007 typically is configured to process real-world signals (e.g., sound) in real time independently of the processor 1003. Similarly, an ASIC 1009 can be configured to performed specialized functions not easily performed by a general purposed processor. Other specialized components to aid in performing the inventive functions described herein include one or more field programmable gate arrays (FPGA) (not shown), one or more controllers (not shown), or one or more other special-purpose computer chips.

The processor 1003 and accompanying components have connectivity to the memory 1005 via the bus 1001. The memory 1005 includes both dynamic memory (e.g., RAM, magnetic disk, writable optical disk, etc.) and static memory (e.g., ROM, CD-ROM, etc.) for storing executable instructions that when executed perform the inventive steps described herein to classify a traffic jam from probe data. The memory 1005 also stores the data associated with or generated by the execution of the inventive steps.

Figure 11:
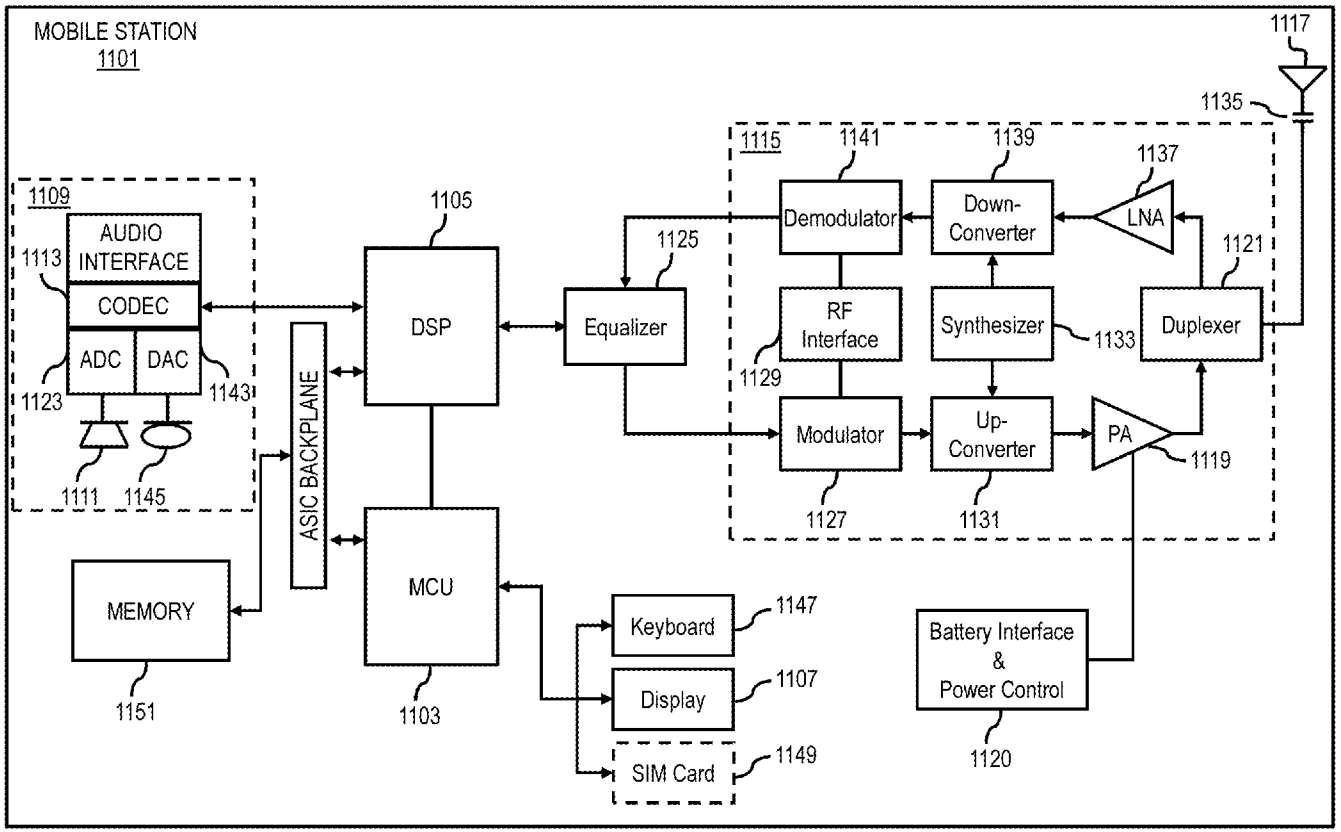
FIG. 11 is a diagram of a mobile terminal (e.g., handset) that can be used to implement an embodiment of the invention.

FIG. 11 is a diagram of exemplary components of a mobile station 1101 (e.g., handset) capable of operating in the system of FIG. 1, according to one embodiment. In one embodiment, the mobile station 1101 can be the UE 209 and/or vehicle 201 or part of the UE 209 and/or vehicle 201. Generally, a radio receiver is often defined in terms of front-end and back-end characteristics. The front-end of the receiver encompasses all of the Radio Frequency (RF) circuitry whereas the back-end encompasses all of the base-band processing circuitry. Pertinent internal components of the telephone include a Main Control Unit (MCU) 1103, a Digital Signal Processor (DSP) 1105, and a receiver/transmitter unit including a microphone gain control unit and a speaker gain control unit. A main display unit 1107 provides a display to the user in support of various applications and mobile station functions that offer automatic contact matching. An audio function circuitry 1109 includes a microphone 1111 and microphone amplifier that amplifies the speech signal output from the microphone 1111. The amplified speech signal output from the microphone 1111 is fed to a coder/decoder (CODEC) 1113.

A radio section 1115 amplifies power and converts frequency in order to communicate with a base station, which is included in a mobile communication system, via antenna 1117. The power amplifier (PA) 1119 and the transmitter/modulation circuitry are operationally responsive to the MCU 1103, with an output from the PA 1119 coupled to the duplexer 1121 or circulator or antenna switch, as known in the art. The PA 1119 also couples to a battery interface and power control unit 1120.

In use, a user of mobile station 1101 speaks into the microphone 1111 and his or her voice along with any detected background noise is converted into an analog voltage. The analog voltage is then converted into a digital signal through the Analog to Digital Converter (ADC) 1123. The control unit 1103 routes the digital signal into the DSP 1105 for processing therein, such as speech encoding, channel encoding, encrypting, and interleaving. In one embodiment, the processed voice signals are encoded, by units not separately shown, using a cellular transmission protocol such as global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., microwave access (WiMAX), Long Term Evolution (LTE) networks, code division multiple access (CDMA), wireless fidelity (WiFi), satellite, and the like.

The encoded signals are then routed to an equalizer 1125 for compensation of any frequency-dependent impairments that occur during transmission though the air such as phase and amplitude distortion. After equalizing the bit stream, the modulator 1127 combines the signal with a RF signal generated in the RF interface 1129. The modulator 1127 generates a sine wave by way of frequency or phase modulation. In order to prepare the signal for transmission, an up-converter 1131 combines the sine wave output from the modulator 1127 with another sine wave generated by a synthesizer 1133 to achieve the desired frequency of transmission. The signal is then sent through a PA 1119 to increase the signal to an appropriate power level. In practical systems, the PA 1119 acts as a variable gain amplifier whose gain is controlled by the DSP 1105 from information received from a network base station. The signal is then filtered within the duplexer 1121 and optionally sent to an antenna coupler 1135 to match impedances to provide maximum power transfer. Finally, the signal is transmitted via antenna 1117 to a local base station. An automatic gain control (AGC) can be supplied to control the gain of the final stages of the receiver. The signals may be forwarded from there to a remote telephone which may be another cellular telephone, other mobile phone or a land-line connected to a Public Switched Telephone Network (PSTN), or other telephony networks.

Voice signals transmitted to the mobile station 1101 are received via antenna 1117 and immediately amplified by a low noise amplifier (LNA) 1137. A down-converter 1139 lowers the carrier frequency while the demodulator 1141 strips away the RF leaving only a digital bit stream. The signal then goes through the equalizer 1125 and is processed by the DSP 1105. A Digital to Analog Converter (DAC) 1143 converts the signal and the resulting output is transmitted to the user through the speaker 1145, all under control of a Main Control Unit (MCU) 1103—which can be implemented as a Central Processing Unit (CPU) (not shown).

The MCU 1103 receives various signals including input signals from the keyboard 1147. The keyboard 1147 and/or the MCU 1103 in combination with other user input components (e.g., the microphone 1111) comprise a user interface circuitry for managing user input. The MCU 1103 runs a user interface software to facilitate user control of at least some functions of the mobile station 1101 to classify a traffic jam from probe data. The MCU 1103 also delivers a display command and a switch command to the display 1107 and to the speech output switching controller, respectively. Further, the MCU 1103 exchanges information with the DSP 1105 and can access an optionally incorporated SIM card 1149 and a memory 1151. In addition, the MCU 1103 executes various control functions required of the station. The DSP 1105 may, depending upon the implementation, perform any of a variety of conventional digital processing functions on the voice signals. Additionally, DSP 1105 determines the background noise level of the local environment from the signals detected by microphone 1111 and sets the gain of microphone 1111 to a level selected to compensate for the natural tendency of the user of the mobile station 1101.

The CODEC 1113 includes the ADC 1123 and DAC 1143. The memory 1151 stores various data including call incoming tone data and is capable of storing other data including music data received via, e.g., the global Internet. The software module could reside in RAM memory, flash memory, registers, or any other form of writable storage medium known in the art. The memory device 1151 may be, but not limited to, a single memory, CD, DVD, ROM, RAM, EEPROM, optical storage, or any other non-volatile storage medium capable of storing digital data.

An optionally incorporated SIM card 1149 carries, for instance, important information, such as the cellular phone number, the carrier supplying service, subscription details, and security information. The SIM card 1149 serves primarily to identify the mobile station 1101 on a radio network.

The card 1149 also contains a memory for storing a personal telephone number registry, text messages, and user specific mobile station settings.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A computer-implemented method for classifying a traffic jam using probe data, comprising:

receiving the probe data that is map-matched to a roadway on which the traffic jam is detected, wherein the probe data is collected from one or more vehicles traveling the roadway;

determining a jam area of the roadway based on the probe data, wherein the jam area corresponds to one or more segments of the roadway affected by the traffic jam;

determining a set of features indicated by the probe data from a portion of the probe data collected from the jam area; and classifying the traffic jam as either a recurring traffic jam or a non-recurring traffic jam based on the set of features, wherein the probe data is received from the one or more vehicles on a continuous batch basis, wherein a batch of the probe data is collected for a predetermined period of time before the batch is processed and a next batch of the probe data is collected for the predetermined period of time, wherein the batch of the probe data is designated as a jam slice when any traffic jam is determined to occur in the roadway based on the batch of the probe data, wherein each probe data in each jam slice is a probe point collected from the one or more vehicles at a point in time that records telemetry data for the one or more vehicles for that point in time, wherein the jam slice is added to a jam group associated with the traffic jam if the jam slice relates to the traffic jam, and wherein a new jam group including the jam slice is created if the jam slice relates to another traffic jam.

2. The method of claim 1, further comprising:

determining a downstream area of the roadway, wherein the downstream area corresponds to one or more other segments of the roadway downstream from the jam area; and determining another set of features indicated by the probe data from another portion of the probe data collected from the downstream area, wherein the classifying of the traffic jam is further based on the another set of features.

3. The method of claim 2, further comprising:

classifying the non-recurring traffic jam as an accident-caused traffic jam based on the set of features, the another set of features, or a combination thereof.

4. The method of claim 2, further comprising:

classifying a severity level of the traffic jam based on the set of features, the another set of features, or a combination thereof.

5. The method of claim 2, wherein the set of features includes a jam normalized speed, a jam speed, a jam probe point density, a density of distinct probe points in the jam area, or a combination thereof; and wherein the another set of features includes a downstream normalized speed, a downstream speed, a downstream probe point density, a density of distinct probe points in the downstream area, a ratio of the downstream stream speed to a jam speed, a ratio of the downstream point density to a jam probe point density, a ratio of the density of distinct probe points in the downstream area to a density of the distinct probe points in the jam area, a variance of a jam-downstream border, a jam length, or a combination thereof.

6. The method of claim 1, wherein the roadway represents one or more lanes of a multi-lane roadway, and wherein the classifying of the traffic jam indicates on which of the one of the more lanes of the multi-lane roadway the traffic jam is detected.

7. The method of claim 1, wherein the classifying of the traffic jam is performed based on the jam group.

8. The method of claim 7, further comprising:

initiating the classifying of the traffic jam when a count of jam slices in the jam group reaches a candidate size value of at least 3.

9. The method of claim 8, further comprising:

determining the candidate size value based on a target response time for the classifying of the traffic jam.

10. The method of claim 1, further comprising:

presenting a result of the classifying of the traffic jam in a map user interface depicting the roadway.

11. An apparatus comprising:

a processor; and a memory including computer program code for a program, the memory and the computer program code configured to, with the processor, cause the apparatus to perform at least the following, receive probe data that is map-matched to a roadway on which a traffic jam is detected, wherein the probe data is collected from one or more vehicles traveling the roadway;

determine a jam area of the roadway based on the probe data, wherein the jam area corresponds to one or more segments of the roadway affected by the traffic jam;

determine a set of features indicated by the probe data from a portion of the probe data collected from the jam area; and classify the traffic jam as either a recurring traffic jam or a non-recurring traffic jam based on the set of features, wherein the probe data is received from the one or more vehicles on a continuous batch basis, wherein a batch of the probe data is collected for a predetermined period of time before the batch is processed and a next batch of the probe data is collected for the predetermined period of time, wherein the batch of the probe data is designated as a jam slice when any traffic jam is determined to occur in the roadway based on the batch of the probe data, wherein each probe data in each jam slice is a probe point collected from the one or more vehicles at a point in time that records telemetry data for the one or more vehicles for that point in time, wherein the jam slice is added to a jam group associated with the traffic jam if the jam slice relates to the traffic jam, and wherein a new jam group including the jam slice is created if the jam slice relates to another traffic jam.

12. The apparatus of claim 11, wherein the apparatus is further caused to:

determine a downstream area of the roadway, wherein the downstream area corresponds to one or more other segments of the roadway downstream from the jam area; and determine another set of features indicated by the probe data from another portion of the probe data collected from the downstream area, wherein the classifying of the traffic jam is further based on the another set of features.

13. The apparatus of claim 12, wherein the apparatus is further caused to:

classify the non-recurring traffic jam as an accident-caused traffic jam based on the set of features, the another set of features, or a combination thereof.

14. The apparatus of claim 12, wherein the apparatus is further caused to:

classify a severity level of the traffic jam based on the set of features, the another set of features, or a combination thereof.

15. The apparatus of claim 11, wherein the roadway represents one or more lanes of a multi-lane roadway, and wherein the classifying of the traffic jam indicates on which of the one of the more lanes of the multi-lane roadway the traffic jam is detected.

16. The apparatus of claim 11, wherein the classifying of the traffic jam is performed based on the jam group.

17. The apparatus of claim 16, wherein the apparatus is further caused to:

initiate the classifying of the traffic jam when a count of jam slices in the jam group reaches a candidate size of at least 3.

18. A non-transitory computer-readable storage medium carrying one or more sequences of one or more instructions which, when executed by one or more processors, cause an apparatus to at least perform the following steps:

receiving probe data that is map-matched to a roadway on which a traffic jam is detected, wherein the probe data is collected from one or more vehicles traveling the roadway;

determining a jam area of the roadway based on the probe data, wherein the jam area corresponds to one or more segments of the roadway affected by the traffic jam;

determining a set of features indicated by the probe data from a portion of the probe data collected from the jam area; and classifying the traffic jam as either a recurring traffic jam or a non-recurring traffic jam based on the set of features, wherein the probe data is received from the one or more vehicles on a continuous batch basis, wherein a batch of the probe data is collected for a predetermined period of time before the batch is processed and a next batch of the probe data is collected for the predetermined period of time, wherein the batch of the probe data is designated as a jam slice when any traffic jam is determined to occur in the roadway based on the batch of the probe data, wherein each probe data in each jam slice is a probe point collected from the one or more vehicles at a point in time that records telemetry data for the one or more vehicles for that point in time, wherein the jam slice is added to a jam group associated with the traffic jam if the jam slice relates to the traffic jam, and wherein a new jam group including the jam slice is created if the jam slice relates to another traffic jam.

19. The computer-readable storage medium of claim 18, wherein the apparatus is further caused to perform:

determining a downstream area of the roadway, wherein the downstream area corresponds to one or more other segments of the roadway downstream from the jam area; and determining another set of features indicated by the probe data from another portion of the probe data collected from the downstream area, wherein the classifying of the traffic jam is further based on the another set of features.

20. The computer-readable storage medium of claim 19, wherein the apparatus is further caused to perform:

classifying the non-recurring traffic jam as an accident-caused traffic jam based on the set of features, the another set of features, or a combination thereof.

* * * * *